US011383513B2

(12) United States Patent
Kamijima et al.

(10) Patent No.: US 11,383,513 B2
(45) Date of Patent: Jul. 12, 2022

(54) LIQUID DISCHARGING APPARATUS, HEAD CONTROL UNIT, AND HEAD UNIT

(71) Applicant: SEIKO EPSON CORPORATION, Tokyo (JP)

(72) Inventors: Masayuki Kamijima, Ina (JP); Masahiro Koiwai, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 196 days.

(21) Appl. No.: 16/750,109

(22) Filed: Jan. 23, 2020

(65) Prior Publication Data

US 2020/0238687 A1 Jul. 30, 2020

(30) Foreign Application Priority Data

Jan. 24, 2019 (JP) ..... JP2019-010398

(51) Int. Cl.
*B41J 2/045* (2006.01)

(52) U.S. Cl.
CPC ..... *B41J 2/04541* (2013.01); *B41J 2/04581* (2013.01)

(58) Field of Classification Search
CPC ..... B41J 2202/20; B41J 2/04541; B41J 2/04581; B41J 2/04588; B41J 2/04593; B41J 2/04596; B41J 29/393
See application file for complete search history.

(56) References Cited

U.S. PATENT DOCUMENTS 6,137,508 A * 10/2000 Gaarder ..... B41J 29/02 347/50
6,357,859 B1 * 3/2002 Klees ..... B41J 29/393 347/50
6,523,920 B2 * 2/2003 Wade ..... B41J 2/17553 347/19
6,715,857 B2 * 4/2004 Coffey ..... B41J 2/14072 347/37
8,210,668 B2 * 7/2012 Espinoza-Ibarra ..... B41J 2/16579 347/86
2002/0080218 A1 * 6/2002 Kaga ..... B41J 2/01 347/104

(Continued)

FOREIGN PATENT DOCUMENTS

JP 2008-183845 A 8/2008

*Primary Examiner* — John Zimmermann
(74) *Attorney, Agent, or Firm* — Oliff PLC

(57) ABSTRACT

In a liquid discharging apparatus, a head control unit, which controls an operation of a head unit, includes a first conversion circuit that converts an image signal input from an outside into a first electric signal, a first photoelectric conversion circuit that converts the first electric signal into an optical signal, the head unit, which discharges a liquid, includes a second photoelectric conversion circuit that converts the optical signal into a second electric signal, a second conversion circuit that converts the second electric signal into a discharge control signal for controlling discharge of a liquid. The first conversion circuit performs a first conversion process of converting the image signal into the first electric signal without depending on a discharge information, and the second conversion circuit performs a second conversion process of converting the second electric signal into the discharge control signal by using the discharge information.

7 Claims, 14 Drawing Sheets

(56) References Cited

U.S. PATENT DOCUMENTS

| | | | | |
|---|---|---|---|---|
| 2006/0214985 | A1* | 9/2006 | Endo | B41J 11/0095 347/14 |
| 2020/0130391 | A1* | 4/2020 | Kamijima | B41J 2/17509 |

* cited by examiner

| [SIH, SIL] | | [1, 1] LARGE DOT | [1, 0] MIDDLE DOT | [0, 1] SMALL DOT | [0, 0] NON-RECORDING |
|---|---|---|---|---|---|
| S1 | T1 | H | H | H | L |
| | T2 | H | L | L | L |
| S2 | T1 | L | L | L | H |
| | T2 | L | H | L | L |

LIQUID DISCHARGING APPARATUS, HEAD CONTROL UNIT, AND HEAD UNIT

The present application is based on, and claims priority from JP Application Serial Number 2019-010398, filed Jan. 24, 2019, the disclosure of which is hereby incorporated by reference herein in its entirety.

BACKGROUND

1. Technical Field

The present disclosure relates to a liquid discharging apparatus, a head control unit, and a head unit.

2. Related Art

In an ink jet printer as an example of a liquid discharging apparatus, a technique has been known which prints an image or a document on a medium by propagating a control signal, which is generated by a control circuit or the like provided on a main body of the ink jet printer, to a print head (printing head) which includes nozzles for discharging ink, and by controlling discharge timing of the ink based on the control signal. In the liquid discharging apparatus, the control signal supplied to the print head is propagated between a main body of the liquid discharging apparatus and the print head.

For example, JP-A-2008-183845 discloses a technique for controlling discharge timing of ink from nozzles included in a printing head mounted on a carriage by generating a printing data signal for controlling discharge of the ink in a printer control portion provided in a main body of a printer, converting the generated printing data signal into an optical signal, and propagating the optical signal from the printer control portion to the carriage.

The signal for controlling the discharge of the ink from the nozzles included in the print head is generated by performing various processes, such as a color conversion process, a half-tone process, an interlace process, and a nozzle complement process, with respect to image data input from an outside of the liquid discharging apparatus. In the various processes, the interlace process and the nozzle complement process are performed based on a signal corresponding to information of the print head. Therefore, as in JP-A-2008-183845, when the printing data signal generated in the main body of the liquid discharging apparatus is converted into the optical signal and the optical signal is propagated to the print head, it is necessary to convert the information of the print head into the optical signal and to propagate the optical signal from the print head to the main body of the liquid discharging apparatus. However, in optical communication in which the optical signal is propagated, conversion time is necessary for conversion from an electric signal into an optical signal and conversion from an optical signal to an electric signal. Therefore, there is a possibility that time is required for generation of the printing data, and thus there is room for improvement from a viewpoint of advancement of a control speed of the liquid discharging apparatus.

SUMMARY

According to an aspect of the present disclosure, there is provided a liquid discharging apparatus including a head unit that discharges a liquid from a nozzle, and a head control unit that controls an operation of the head unit, in which the head control unit includes a first conversion circuit that converts an image signal, which includes image data input from an outside, into a first electric signal, and a first photoelectric conversion circuit that converts the first electric signal into an optical signal, the head unit includes a second photoelectric conversion circuit that converts the optical signal into a second electric signal, a second conversion circuit that converts the second electric signal into a discharge control signal for controlling discharge of a liquid from the nozzle, and a liquid discharging head that includes a driving element, which is driven based on the discharge control signal, and that discharges a liquid from the nozzle in accordance with drive of the driving element, the first conversion circuit performs a first conversion process of converting the image signal into the first electric signal without depending on a discharge information of a liquid discharged from the liquid discharging head, and the second conversion circuit performs a second conversion process of converting the second electric signal into the discharge control signal by using the discharge information.

In the liquid discharging apparatus, the discharge information may include information which indicates whether or not to discharge a liquid from the nozzle.

In the liquid discharging apparatus, the first conversion process may include a color conversion process of converting color information corresponding to a hue of the image data included in the image signal into color information corresponding to a hue of a liquid discharged from the nozzle.

In the liquid discharging apparatus, the first conversion process may include a binarization process of converting the image signal into a signal which indicates whether or not a liquid corresponding to a pixel included in the image data is discharged.

In the liquid discharging apparatus, the first electric signal may be a signal acquired by performing the binarization process on a signal based on the image signal.

In the liquid discharging apparatus, the second conversion process may include a nozzle correspondence process of converting the second electric signal into a signal which indicates whether or not a liquid corresponding to the nozzle is discharged.

According to another aspect of the present disclosure, there is provided a head control unit, which controls an operation of a head unit that discharges a liquid from a nozzle, the head control unit including a first conversion circuit that converts an image signal, which includes image data input from an outside, into a first electric signal, and a first photoelectric conversion circuit that converts the first electric signal into an optical signal, in which the first conversion circuit performs a first conversion process of converting the image signal into the first electric signal without depending on a discharge information of a liquid discharged from the head unit.

According to another aspect of the present disclosure, there is provided a head unit, which discharges a liquid from a nozzle based on a signal input from a head control unit, the head unit including a second photoelectric conversion circuit that receives an optical signal input from the head control unit, and converts the optical signal into a second electric signal, a second conversion circuit that converts the second electric signal into a discharge control signal for controlling discharge of a liquid from the nozzle, and a liquid discharging head that includes a driving element, which is driven based on the discharge control signal, and that discharges a liquid from the nozzle in accordance with drive of the driving element, in which the second conversion circuit performs a second conversion process of converting the second electric signal into the discharge control signal by using a discharge information of a liquid discharged from the liquid discharging head.

DESCRIPTION OF EXEMPLARY EMBODIMENTS

Hereinafter, exemplary embodiments of the present disclosure will be described with reference to the accompanying drawings. The used drawings are for convenience of description. The embodiments described below do not wrongfully limit the scope of the present disclosure as set forth in the claims. Further, not all of configurations described below are necessarily essential configuration requirements of the present disclosure.

1. Outline of Liquid Discharging Apparatus

A configuration of a liquid discharging apparatus 1 according to the present embodiment will be described with reference to FIGS. 1 to 4.

Figure 1:
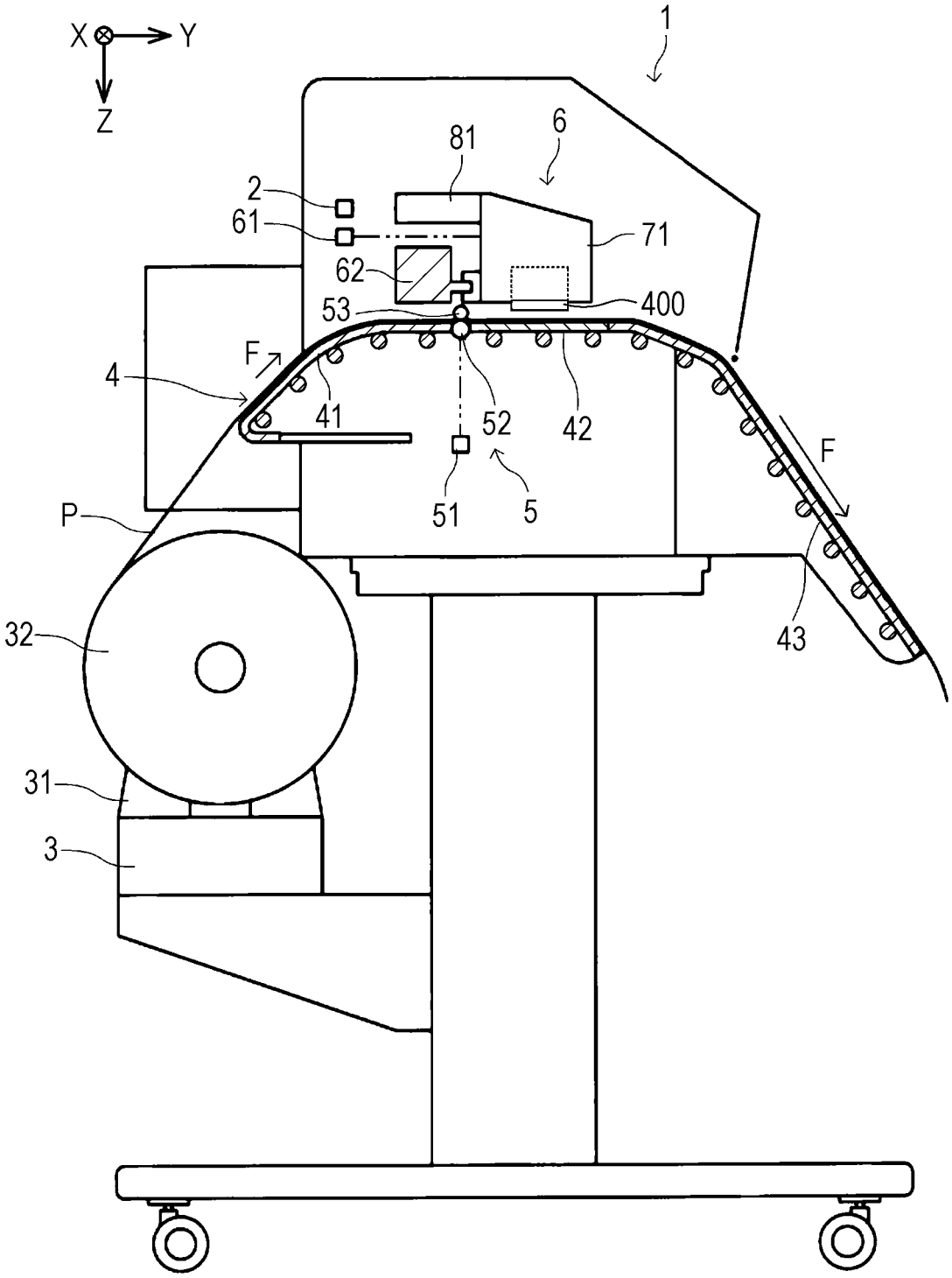
FIG. 1 is a side view illustrating a configuration of a liquid discharging apparatus.
Figure 2:
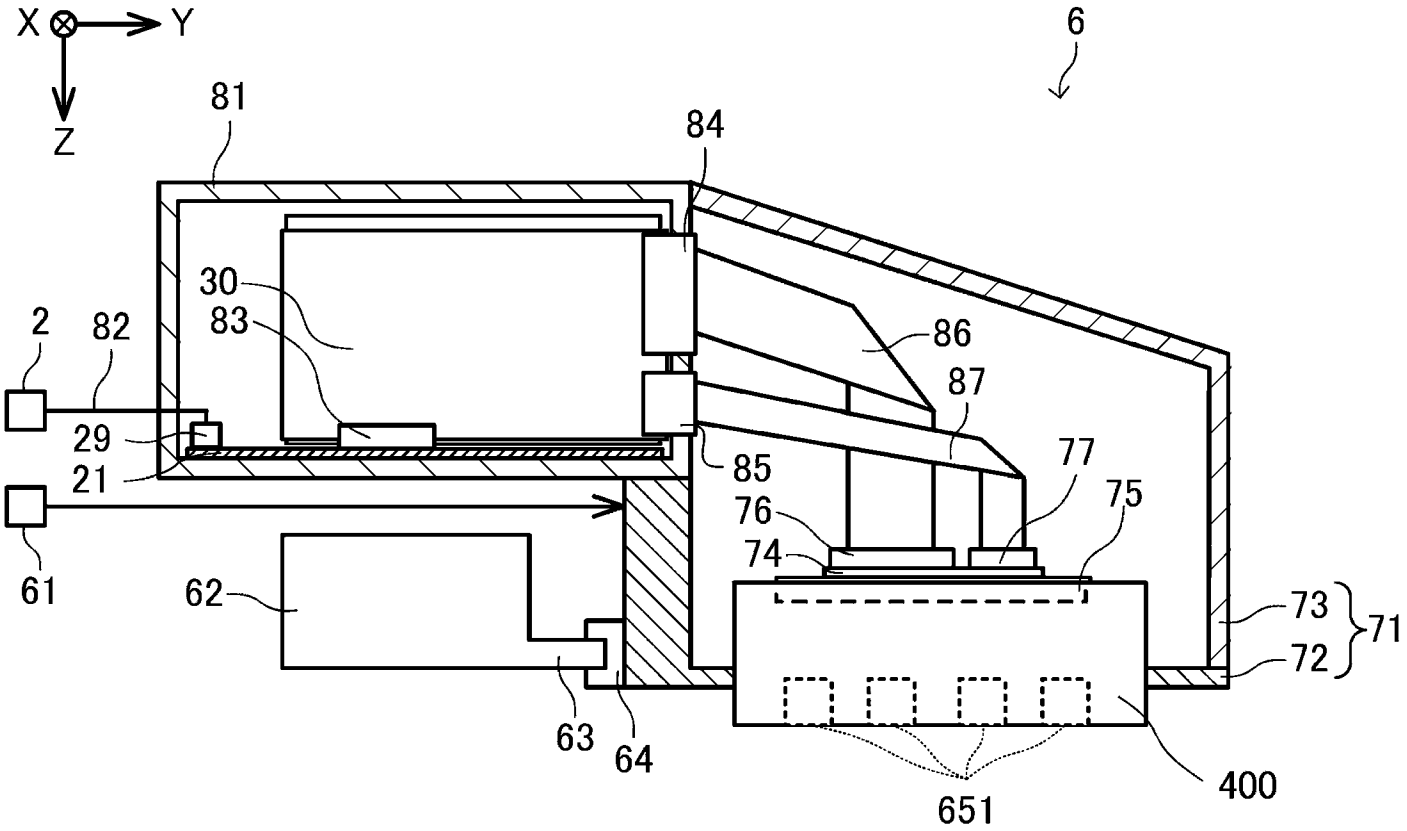
FIG. 2 is a side view illustrating a peripheral configuration of a printing portion of the liquid discharging apparatus.
Figure 3:
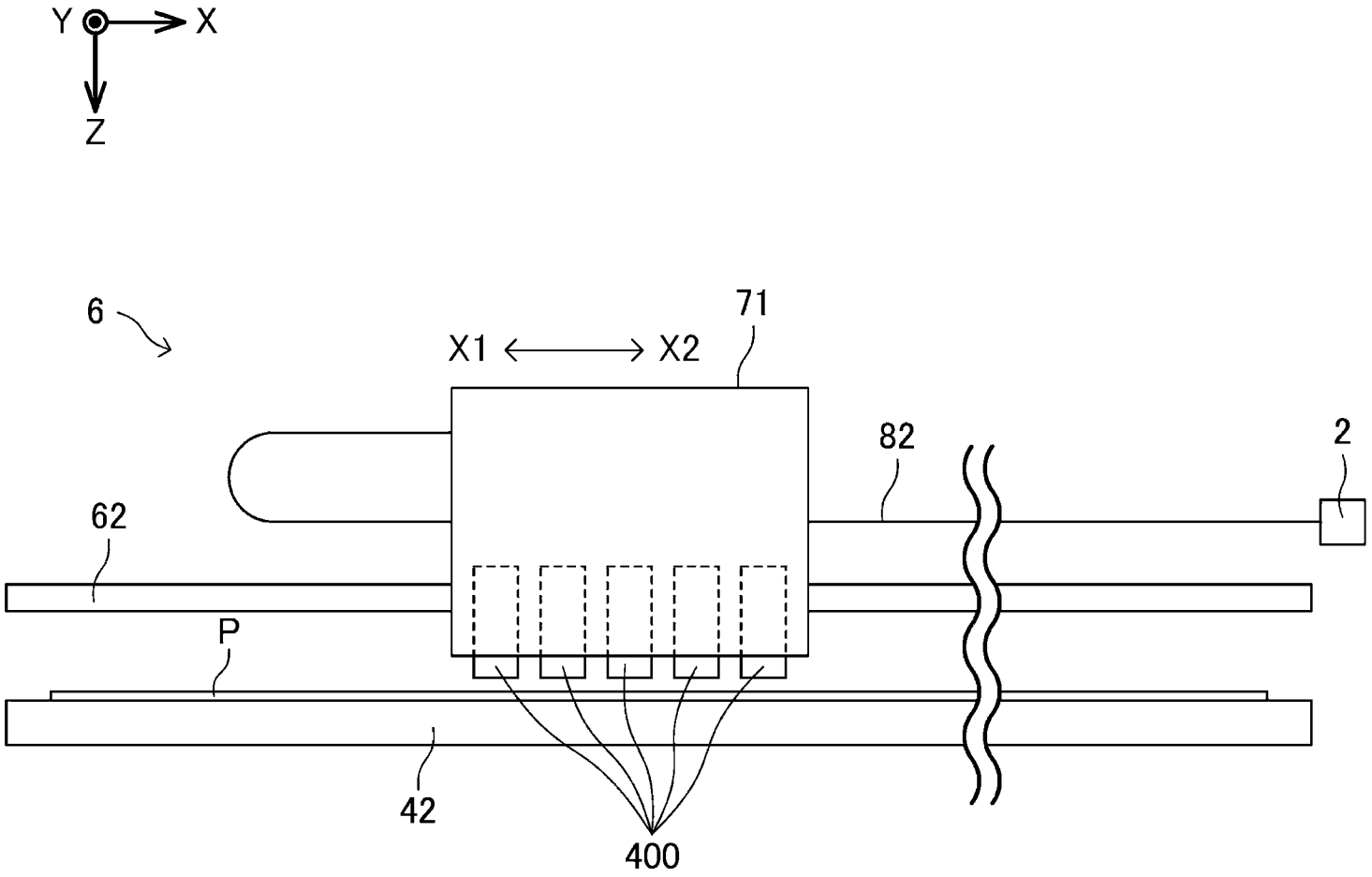
FIG. 3 is a front view illustrating the peripheral configuration of the printing portion of the liquid discharging apparatus.
Figure 4:
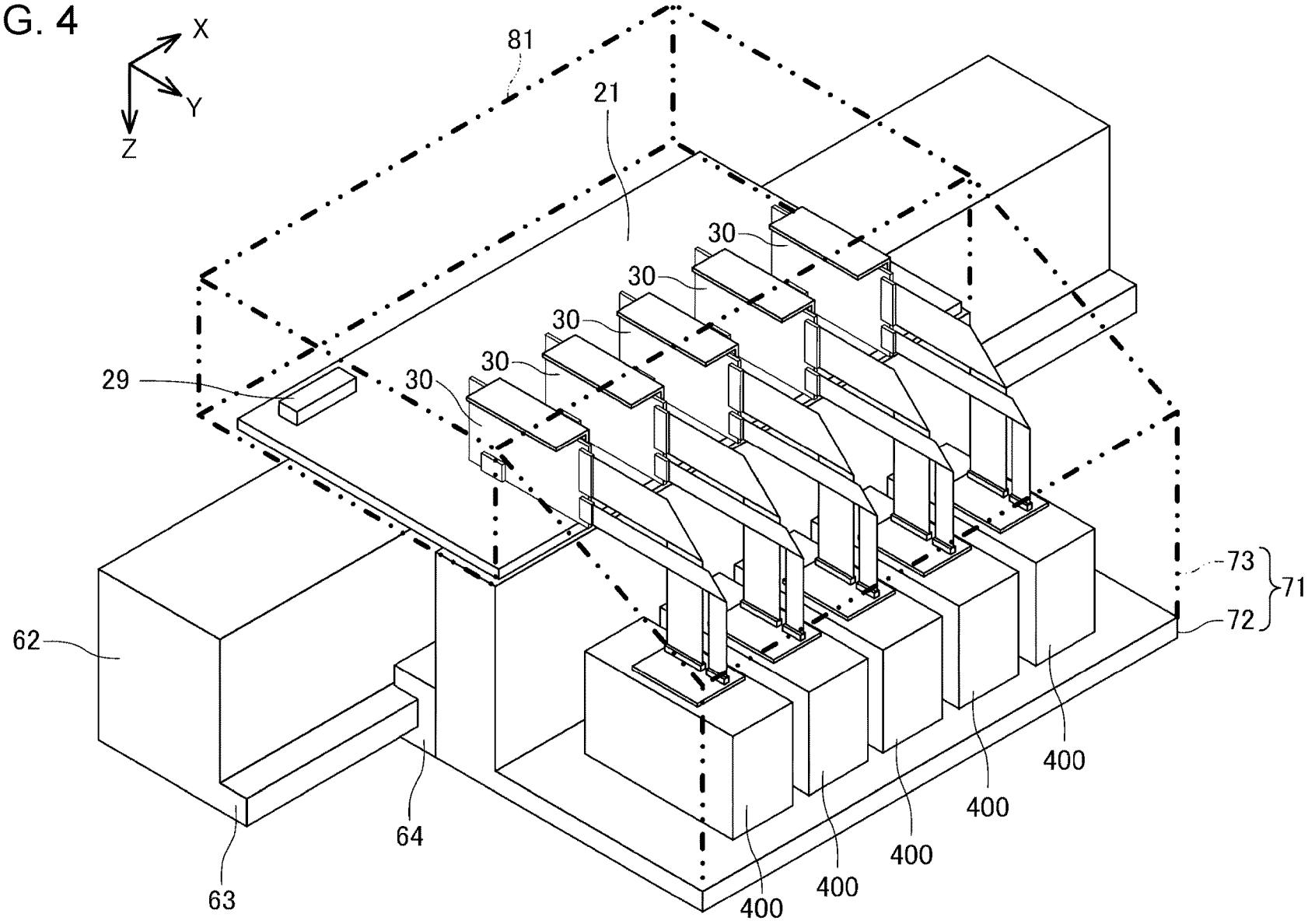
FIG. 4 is a perspective view illustrating the peripheral configuration of the printing portion of the liquid discharging apparatus.

FIG. 1 is a side view illustrating a configuration of a liquid discharging apparatus 1. FIG. 2 is a side view illustrating a peripheral configuration of a printing portion 6 of the liquid discharging apparatus 1. FIG. 3 is a front view illustrating the peripheral configuration of the printing portion 6 of the liquid discharging apparatus 1. FIG. 4 is a perspective view illustrating the peripheral configuration of the printing portion 6 of the liquid discharging apparatus 1.

As illustrated in FIG. 1, the liquid discharging apparatus 1 includes a delivery portion 3 that delivers a medium P, a support portion 4 that supports the medium P, a transport portion 5 that transports the medium P, the printing portion 6 that performs printing on the medium P, and a control portion 2 that controls these configurations.

In the following description, the width direction of the liquid discharging apparatus 1 is referred to as an X direction, the depth direction of the liquid discharging apparatus 1 is referred to as a Y direction, and the height direction of the liquid discharging apparatus 1 is referred to as a Z direction. Further, a direction in which the medium P is transported is referred to as a transport direction F. The X direction, the Y direction, and the Z direction are perpendicular to each other. Further, the transport direction F is a direction which intersects the X direction.

The control portion 2 is fixed to an inside of the liquid discharging apparatus 1 to generate various signals for controlling the liquid discharging apparatus 1 and to output the generated signals to corresponding various configurations.

The delivery portion 3 includes a holding member 31. The holding member 31 rotatably holds a roll body 32 on which the medium P is wound and stacked. The holding member 31 holds different kinds of media P and roll bodies 32 having different dimensions in the X direction. Further, in the delivery portion 3, as the roll body 32 is rotated in one direction, the medium P unwound from the roll body 32 is delivered to the support portion 4.

The support portion 4 includes a first support portion 41, a second support portion 42, and a third support portion 43, which constitute a transport path of the medium P from an upstream to a downstream in the transport direction F. The first support portion 41 guides the medium P delivered from the delivery portion 3 toward the second support portion 42. The second support portion 42 supports the medium P on which printing is performed. Further, the third support portion 43 guides the printed medium P toward the downstream in the transport direction F.

The transport portion 5 includes a transport roller 52 that applies a transport force to the medium P, a driven roller 53 that presses the medium P against the transport roller 52, and a rotary mechanism 51 that drives the transport roller 52.

The transport roller 52 is disposed beneath the transport path of the medium P in the Z direction, and the driven roller 53 is disposed on the transport path of the medium P in the Z direction. The rotary mechanism 51 is configured with, for example, a motor and a reduction gear. Further, in the transport portion 5, as the transport roller 52 rotates in a state in which the medium P is nipped by the transport roller 52 and the driven roller 53, the medium P is transported in the transport direction F.

As illustrated in FIGS. 2 to 4, the printing portion 6 includes a carriage 71, a guide member 62, a movement mechanism 61, and a heat dissipating case 81.

The carriage 71 includes a carriage main body 72 and a carriage cover 73, and is provided to reciprocate along the X direction in a state of facing the medium P. The carriage main body 72 forms an approximately L-shape when viewed from the X direction. The carriage cover 73 is detachably provided with respect to the carriage main body 72. Further, an enclosed space is formed when the carriage cover 73 is attached to the carriage main body 72. At a lower portion of the carriage main body 72, five liquid discharging heads 400 are mounted at regular intervals in the X direction. Each of the liquid discharging heads 400 includes a lower end portion provided to protrude outward from a lower surface of the carriage main body 72. A plurality of nozzles 651 for discharging the ink, as an example of a liquid, to the medium P are formed on a lower surface of the liquid discharging head 400.

The guide member 62 extends along the X direction. Further, on the guide member 62, the carriage 71 is supported to reciprocate along the X direction. Specifically, the guide member 62 includes a guide rail portion 63 extending from a lower portion of a front surface of the guide member 62 in the X direction. Further, the carriage 71 has a carriage support portion 64 at a lower portion of a rear surface of the carriage 71. The carriage support portion 64 is supported to slide on the guide rail portion 63. Therefore, the carriage 71 is coupled to reciprocate along the guide member 62.

The movement mechanism 61 includes a motor and a reduction gear. Further, the movement mechanism 61 controls normal rotation and reverse rotation of the motor, and converts a rotational force of the motor into a moving force in the X direction of the carriage 71. Therefore, the carriage 71 reciprocates along the X direction in a state in which the five liquid discharging heads 400, five driving circuit boards 30, and a discharge control circuit board 21 are mounted. Further, the movement mechanism 61 may adjust a position in the Z direction of the carriage 71 by controlling the motor and the reduction gear. Therefore, even when the medium P which has different thickness is used, it is possible to adjust a distance between the liquid discharging head 400 and the medium P, and thus it is possible to increase landing accuracy of the ink which lands on the medium P.

The heat dissipating case 81 has an approximately rectangular parallelepiped shape in which the discharge control circuit board 21 and the five driving circuit boards 30 are accommodated. A front end portion of the heat dissipating case 81 is fixed to an upper end portion of the rear portion of the carriage 71. That is, the discharge control circuit board 21 and the five driving circuit boards 30 are mounted on the carriage 71 via the heat dissipating case 81.

A connector 29 is provided on the discharge control circuit board 21. A plurality of cables 82 for coupling the control portion 2 to the discharge control circuit board 21 are coupled to the connector 29. That is, the cables 82 are provided between the discharge control circuit board 21, which is mounted on the carriage 71 that reciprocates in the X direction, and the control portion 2, which is fixed to the liquid discharging apparatus 1, for communication, and the cables 82 propagate various signals. Further, the five driving circuit boards 30 are installed upward the discharge control circuit board 21 in the Z direction and are provided in parallel in the X direction. The discharge control circuit board 21 and each of the driving circuit boards 30 are connected through a connector 83 such as a Board to Board (B to B) connector.

Connectors 84 and 85 are provided at a front end portion of each of the five driving circuit boards 30. Each of the connectors 84 and 85 is exposed from a front surface of the heat dissipating case 81. One end of a cable 86 is coupled to the connector 84, and one end of a cable 87 is coupled to the connector 85.

Further, a connection board 74 is provided on an upper surface of each of the five liquid discharging heads 400. The connection board 74 is electrically coupled to the liquid discharging head 400 via a connector 75 such as a B to B connector. Connectors 76 and 77 are provided on the connection board 74. Another end of the cable 86 is coupled to the connector 76, and another end of the cable 87 is coupled to the connector 77. Therefore, the five driving circuit boards 30 and the five relevant liquid discharging heads 400 are electrically coupled to each other.

In the description with reference to FIGS. 1 to 4, description is performed such that the liquid discharging apparatus 1 includes the five driving circuit boards 30 and the five liquid discharging heads 400. However, the number of driving circuit boards 30 and the number of liquid discharging heads 400 are not limited to five.

As above, in the liquid discharging apparatus 1, the various signals, which are generated by the control portion 2 fixed to a main body of the liquid discharging apparatus 1, are input to various configurations including the driving circuit board 30 and the liquid discharging head 400, which are mounted on the carriage 71 provided to be reciprocated, via the cable 82. Further, the carriage 71 reciprocates along the X direction, which is the scanning direction, under the control of the movement mechanism 61, the medium P is transported along the transport direction F under the control of the rotary mechanism 51, and the liquid discharging head 400 discharges the ink along the Z direction which is an ink discharge direction. Therefore, an image is formed on the medium P.

2. Electrical Configuration of Liquid Discharging Apparatus

Figure 5:
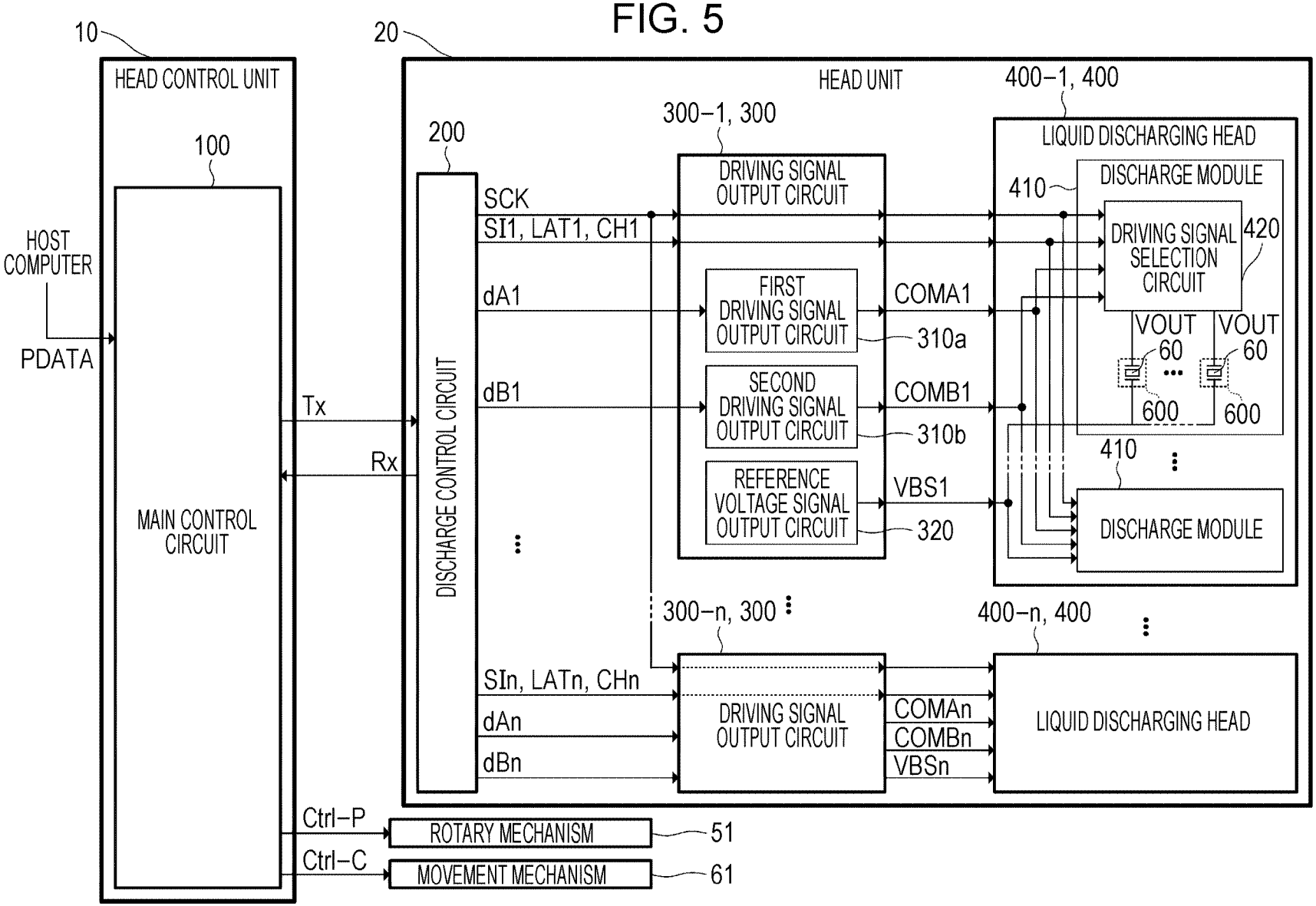
FIG. 5 is a block diagram illustrating an electrical configuration of the liquid discharging apparatus.

Subsequently, an electrical configuration of the liquid discharging apparatus 1 will be described. FIG. 5 is a block diagram illustrating the electrical configuration of the liquid discharging apparatus 1. As illustrated in FIG. 5, the liquid discharging apparatus 1 includes a head control unit 10 and a head unit 20.

The head control unit 10 includes a main control circuit 100 included in the above-described control portion 2, and controls an operation of the head unit 20.

The main control circuit 100 outputs, to the head unit 20, a transmission signal Tx, which includes a signal acquired by performing various processes or the like on the image signal PDATA supplied from a not-shown host computer. Details of the processes performed on the image signal PDATA by the main control circuit 100 will be described later.

Further, the main control circuit 100 generates a control signal Ctrl-P for controlling transport of the medium P, and outputs the control signal Ctrl-P to the rotary mechanism 51. The rotary mechanism 51 controls rotation of the above-described transport roller 52 by controlling the above-described motor and the reduction gear in accordance with the control signal Ctrl-P, and transports the medium P. Further, the main control circuit 100 generates a control signal Ctrl-C for controlling movement of the carriage 71, and outputs the control signal Ctrl-C to the movement mechanism 61. The movement mechanism 61 moves the carriage 71 by controlling the above-described motor, the reduction gear, and the like in accordance with the control signal Ctrl-C.

The head unit 20 causes the nozzles 651 to discharge the liquid. Specifically, the head unit 20 includes a discharge control circuit 200, n driving signal output circuits 300 and n liquid discharging heads 400. There are cases where the n driving signal output circuits 300 are respectively referred to as driving signal output circuits 300-1 to **300-*n* for discrimination, and the n liquid discharging heads 400 are respectively referred to as liquid discharging heads 400-1 to 400-*n* for discrimination. Further, description is performed such that a driving signal output circuit 300-*i* (i=any of 1 to n) is provided to correspond to a liquid discharging head 400-*i***.

The discharge control circuit 200 is provided on the above-described discharge control circuit board 21. Further, the discharge control circuit 200 generates printing data signals SI1 to SIn, latch signals LAT1 to LATn, change signals CH1 to CHn, base driving signals dA1 to dAn and dB1 to dBn, and a clock signal SCK based on the transmission signal Tx, and outputs the generated signals to the relevant driving signal output circuits 300-1 to **300-*n*. Further, the discharge control circuit 200 generates a reception signal Rx, which includes a signal indicative of reception of the transmission signal Tx input from the main control circuit 100, and outputs the reception signal Rx to the main control circuit 100**.

Each of the driving signal output circuits 300-1 to **300*n* is provided on the above-described driving circuit board 30. The driving signal output circuit 300-1 includes a first driving signal output circuit 310*a*, a second driving signal output circuit 310*b*, and a reference voltage signal output circuit 320. The base driving signal dA1, which is a digital signal, is input to the first driving signal output circuit 310*a*. The first driving signal output circuit 310*a* performs digital/analog signal conversion on the base driving signal dA1, generates a driving signal COMA1 by performing class D amplification on the analog signal acquired through the digital/analog signal conversion, and outputs the driving signal COMA1 to the liquid discharging head 400-1. Further, the base driving signal dB1, which is the digital signal, is input to the second driving signal output circuit 310*b*. The second driving signal output circuit 310*b* performs the digital/analog signal conversion on the base driving signal dB1, generates a driving signal COMB1 by performing the class D amplification on the analog signal acquired through the digital/analog signal conversion, and outputs the driving signal COMB1 to the liquid discharging head 400-1. The first driving signal output circuit 310*a* and the second driving signal output circuit 310*b*** may have the same configuration, and, for example, may include a class A amplification circuit, a class B amplification circuit, a class AB amplification circuit, or the like.

The reference voltage signal output circuit 320 generates a reference voltage signal VBS1 indicative of a reference potential of the driving signals COMA1 and COMB1, and outputs the reference voltage signal VBS1 to the liquid discharging head 400-1. For example, the reference voltage signal VBS1 is a signal of a DC voltage having a voltage value of 6 V.

Further, the driving signal output circuit 300-1 propagates the printing data signal SI1, the latch signal LAT1, the change signal CH1, and the clock signal SCK, and outputs the printing data signal SI1, the latch signal LAT1, the change signal CH1, and the clock signal SCK to the liquid discharging head 400-1.

The driving signal output circuits 300-1 to **300-*n* have the same configuration, and detailed description is not repeated. That is, the base driving signals dAi and dBi are input to the driving signal output circuit 300-*i*. Further, the driving signal output circuit 300-*i* generates driving signals COMAi and COMBi and a reference voltage signal VBSi, and outputs the driving signals COMAi and COMBi and the reference voltage signal VBSi to the relevant liquid discharging head 400-*i*. Further, the driving signal output circuit 300-*i* propagates a printing data signal SIi, a latch signal LATi, a change signal CHi, and the clock signal SCK, and outputs the printing data signal SIi, the latch signal LATi, the change signal CHi, and the clock signal SCK to the relevant liquid discharging head 400-*i***.

The liquid discharging head 400-1 includes piezoelectric elements 60 which are examples of driving elements which are driven based on the driving signals COMA1 and COMB1, and causes the nozzles 651 to discharge ink by driving the piezoelectric elements 60. The liquid discharging head 400-1 includes a plurality of discharge modules 410. Each of the plurality of discharge modules 410 includes a driving signal selection circuit 420 and a plurality of discharge portions 600.

The driving signal selection circuit 420 includes, for example, an integrated circuit (IC) apparatus. The printing data signal SI1, the latch signal LAT1, the change signal CH1, the clock signal SCK, and the driving signals COMA1 and COMB1 are input to the driving signal selection circuit 420. Further, the driving signal selection circuit 420 generates a driving signal VOUT by performing selection or non-selection in accordance with the printing data signal SI1 on the input driving signals COMA1 and COMB1 at timing prescribed by using the latch signal LAT1 and the change signal CH1. The driving signal VOUT generated by the driving signal selection circuit 420 is supplied to one end of the piezoelectric element 60 included in each of the plurality of discharge portions 600.

Further, the reference voltage signal VBS1 is supplied to another end of the piezoelectric element 60 included in each of the plurality of discharge portions 600 included in the liquid discharging head 400-1. Further, the plurality of piezoelectric elements 60 are driven based on the driving signal VOUT and the reference voltage signal VBS1, and cause the amount of ink to be discharged in accordance with the drive of piezoelectric elements 60.

Here, the liquid discharging heads 400-1 to **400-*n* have the same configuration. Specifically, the printing data signal SIi, the latch signal LATi, the change signal CHi, the clock signal SCK, and the driving signals COMAi and COMBi are input to the liquid discharging head 400-*i*, and the driving signal VOUT is generated. Further, the generated driving signal VOUT is supplied to one end of the piezoelectric element 60 included in each of the plurality of discharge portions 600 included in the liquid discharging head 400-*i*. Further, the reference voltage signal VBSi is supplied to one end of the piezoelectric element 60 included in each of the plurality of discharge portions 600 included in the liquid discharging head 400-*i*. Further, the plurality of piezoelectric elements 60 are driven based on the driving signal VOUT and the reference voltage signal VBSi, and cause the ink, the amount of which corresponds to the drive of piezoelectric elements 60**, to be discharged.

3. Configuration and Operation of Liquid Discharging Head

Subsequently, a configuration and an operation of the liquid discharging head 400 will be described. When the configuration of the liquid discharging head 400 is described, description is performed while the printing data signal SIi, the latch signal LATi, the change signal CHi, the clock signal SCK, the driving signals COMAi and COMBi, and the reference voltage signal VBSi, which are supplied to the liquid discharging head 400, are respectively referred to as a printing data signal SI, a latch signal LAT, a change signal CH, a clock signal SCK, driving signals COMA and COMB, and a reference voltage signal VBS.

Figure 6:
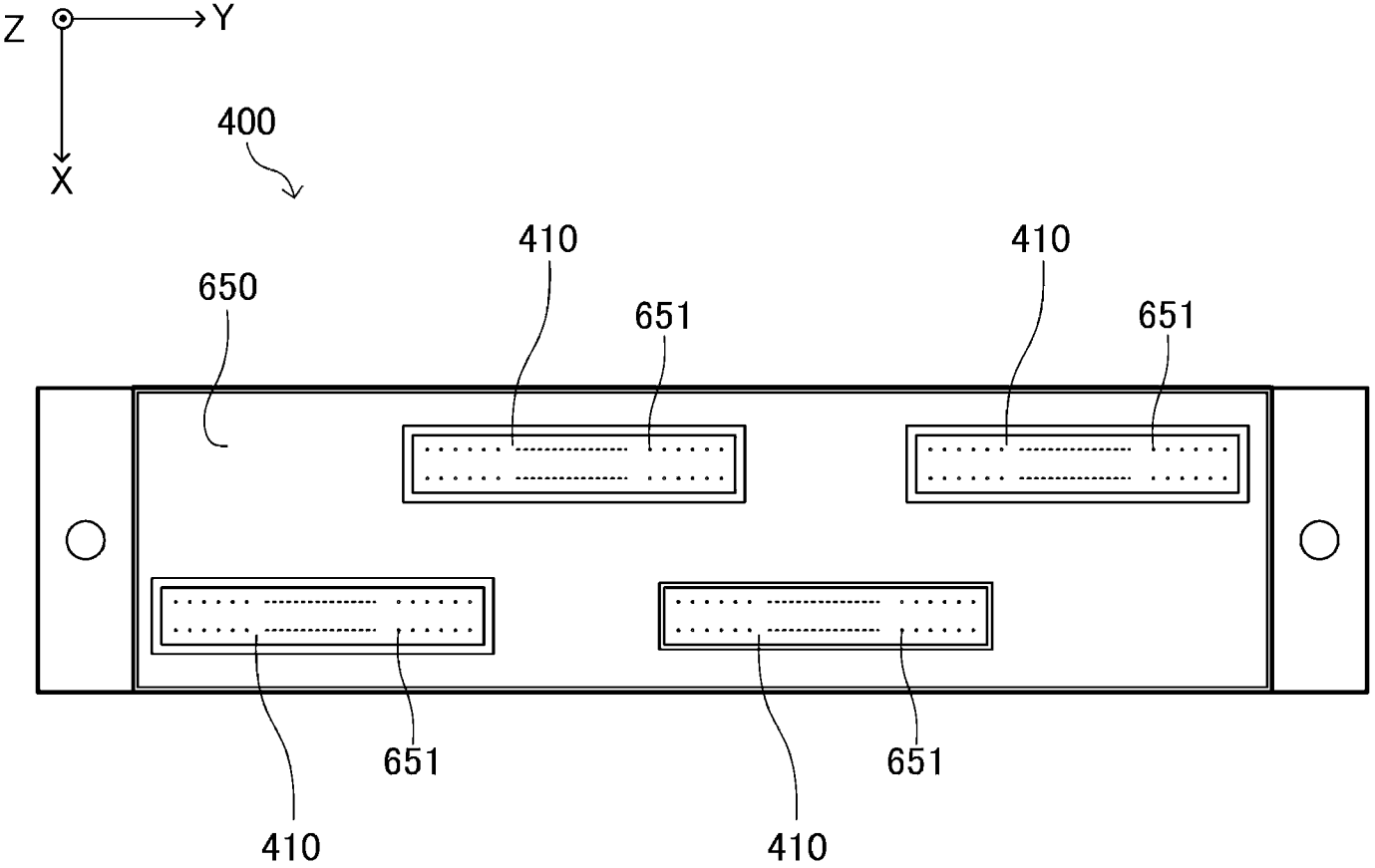
FIG. 6 is a diagram illustrating a configuration of an ink discharge surface.
Figure 7:
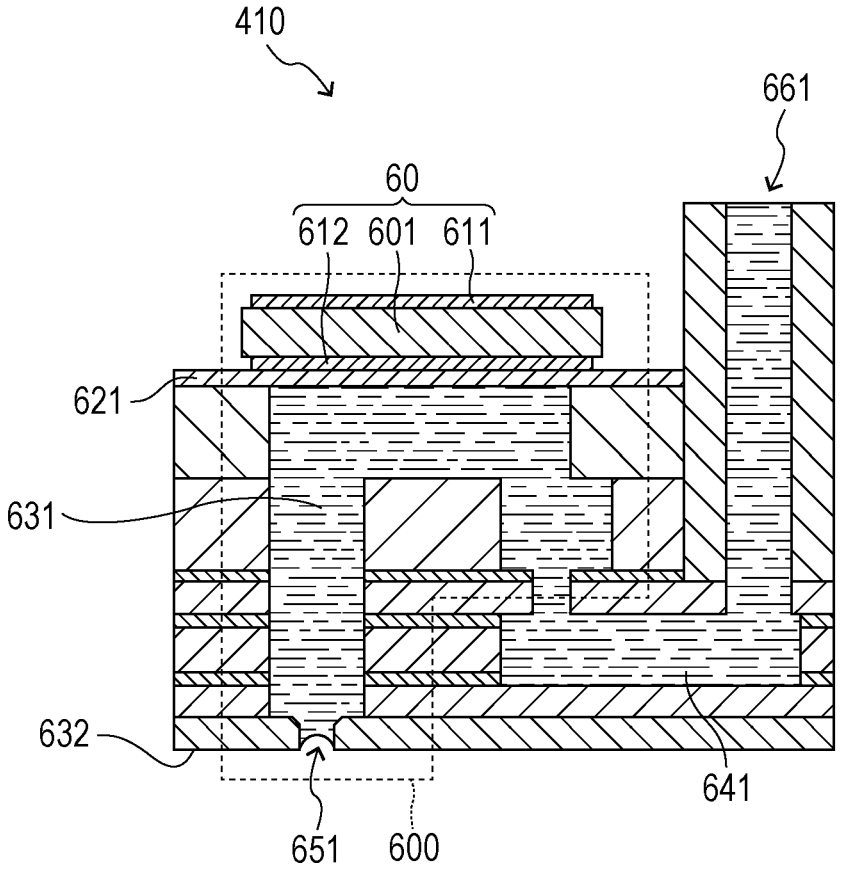
FIG. 7 is a diagram illustrating a schematic configuration of one of a plurality of discharge portions.

FIG. 6 is a diagram illustrating a configuration of an ink discharge surface 650, on which the plurality of nozzles 651 are formed, in the liquid discharging head 400. FIG. 7 is a diagram illustrating a schematic configuration of one of the plurality of discharge portions 600 included in the discharge module 410. As illustrated in FIGS. 6 and 7, the liquid discharging head 400 includes the plurality of nozzles 651 for discharging the ink and the piezoelectric elements 60 corresponding to the respective nozzles 651.

As illustrated in FIG. 6, four discharge modules 410 are disposed in zigzag in the liquid discharging head 400. In each of the discharge modules 410, the nozzles 651, which are provided in parallel in the Y direction, are formed in two lines in the X direction. Further, a not-shown ink channel, which communicates with the nozzles 651, is provided in the discharge module 410. The number of discharge modules 410 included in the liquid discharging head 400 is not limited to four.

Further, as illustrated in FIG. 7, the discharge module 410 includes the discharge portion 600 and a reservoir 641. The ink is introduced from an ink supply port 661 into the reservoir 641.

The discharge portion 600 includes the piezoelectric element 60, a diaphragm 621, a cavity 631, and the nozzle 651. The diaphragm 621 is deformed in accordance with drive of the piezoelectric element 60 provided on an upper surface in FIG. 7. The diaphragm 621 functions as a diaphragm that enlarges/reduces an internal volume of the cavity 631. The ink is filled in the cavity 631. Further, the cavity 631 functions as a compression chamber, the internal volume of which changes in accordance with the displacement of the diaphragm 621 due to the drive of the piezoelectric element 60. The nozzle 651 is an opening portion which is formed in a nozzle plate 632 and which communicates with the cavity 631. The ink stored inside the cavity 631 is discharged from the nozzle 651 in accordance with the change in the internal volume of the cavity 631.

The piezoelectric element 60 has a structure in which a piezoelectric body 601 is interposed between a pair of electrodes 611 and 612. In the piezoelectric body 601 having this structure, central portions of the electrodes 611 and 612 and the diaphragm 621 are bent in a vertical direction of FIG. 7 with respect to both end portions in accordance with a potential difference between the electrode 611 and the electrode 612. Specifically, the driving signal VOUT is supplied to the electrode 611 which is the one end of the piezoelectric element 60, and the reference voltage signal VBS is supplied to the electrode 612 which is the other end of the piezoelectric element 60. Further, when the voltage of the driving signal VOUT decreases, the piezoelectric element 60 is driven such that a central portion is bent upward, and when the voltage of the driving signal VOUT increases, the piezoelectric element 60 is driven such that the central portion is bent downward. When the piezoelectric element 60 is bent upward, the diaphragm 621 performs displacement upward, and internal volume of the cavity 631 is enlarged. Therefore, the ink is drawn from the reservoir 641. Further, when the piezoelectric element 60 is bent downward, the diaphragm 621 performs displacement downward, and internal volume of the cavity 631 is reduced. Therefore, the ink, the amount of which corresponds a degree of the reduction of the internal volume of the cavity 631, is discharged from the nozzle 651. As above, the liquid discharging head 400 includes the piezoelectric element 60, and discharges the ink to the medium by driving the piezoelectric element 60. The piezoelectric element 60 is not limited to the illustrated structure, and may have any structure that can discharge the ink in accordance with the displacement of the piezoelectric element 60. Further, the piezoelectric element 60 is not limited to bending vibration, and may be configured to use longitudinal vibration.

Here, examples of waveforms of the driving signals COMA and COMB, which are the basis of the driving signal VOUT supplied to the piezoelectric element 60, and examples of waveforms of the driving signal VOUT will be described.

Figure 8:
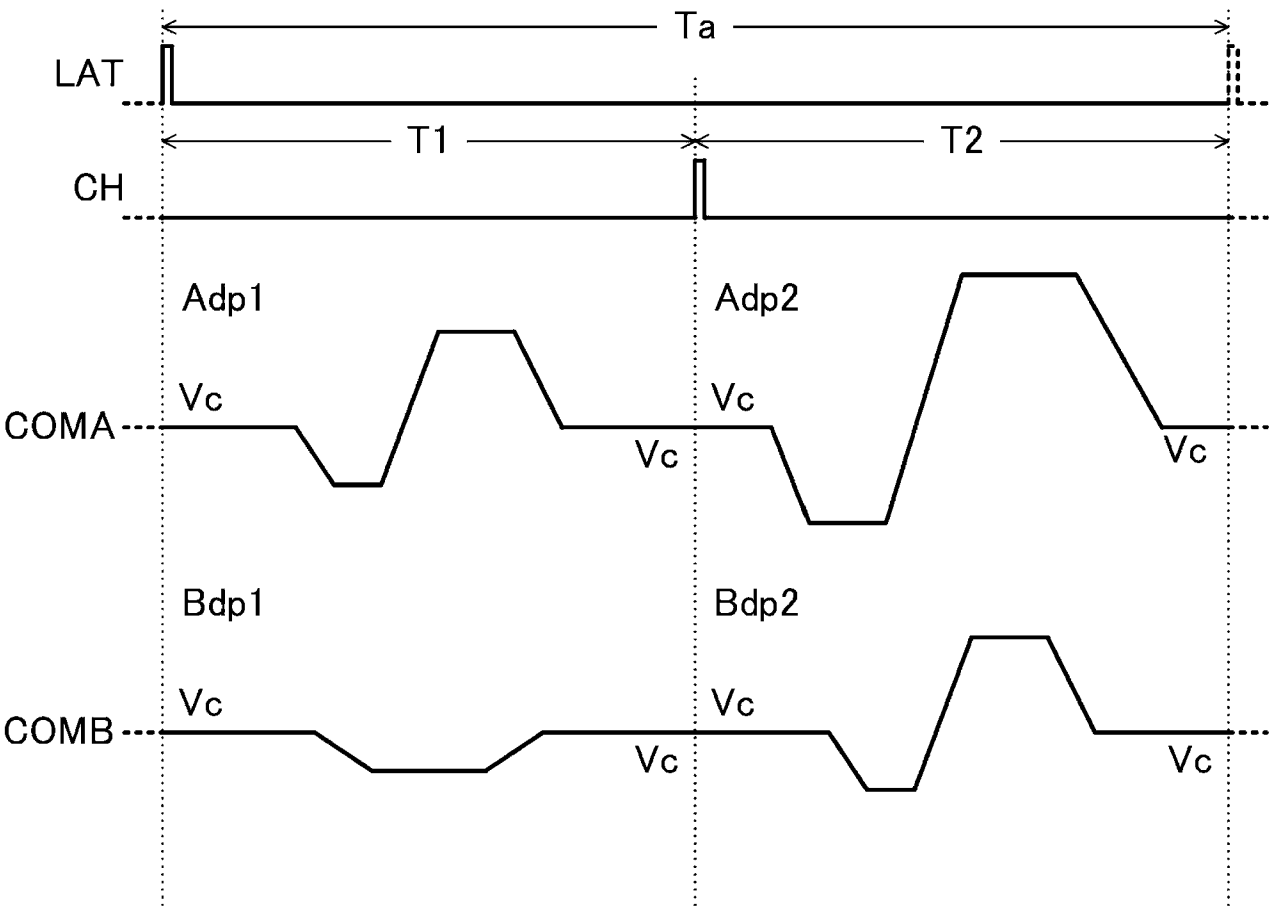
FIG. 8 is a diagram illustrating examples of waveforms of driving signals COMA and COMB.

FIG. 8 a diagram illustrating examples of the waveforms of driving signals COMA and COMB. As illustrated in FIG. 8, the driving signal COMA has a waveform in which a trapezoidal waveform Adp1 disposed in a period T1 from rise of the latch signal LAT to rise of the change signal CH and a trapezoidal waveform Adp2 disposed in a period T2 from the rise of the change signal CH to the rise of the latch signal LAT. Further, when the trapezoidal waveform Adp1 is supplied to the one end of the piezoelectric element 60, a small amount of ink is discharged from the discharge portion 600 corresponding to the corresponding piezoelectric element 60. When the trapezoidal waveform Adp2 is supplied to the one end of the piezoelectric element 60, a middle amount of the ink, which is larger than the small amount, is discharged from the discharge portion 600 corresponding to the corresponding piezoelectric element 60.

Further, the driving signal COMB has a waveform in which a trapezoidal waveform Bdp1 disposed in the period T1 and a trapezoidal waveform Bdp2 disposed in the period T2 are continuous. Further, when the trapezoidal waveform Bdp1 is supplied to the one end of the piezoelectric element 60, the ink is not discharged from the discharge portion 600 corresponding to the relevant piezoelectric element 60. The trapezoidal waveform Bdp1 is a waveform for finely vibrating the ink near a nozzle opening portion of the discharge portion 600 to prevent an increase in the viscosity of the ink. Further, when the trapezoidal waveform Bdp2 is supplied to the one end of the piezoelectric element 60, the small amount of the ink is discharged from the discharge portion 600 corresponding to the corresponding piezoelectric element 60, which is like a case where the trapezoidal waveform Adp1 is supplied.

Here, all voltages at start timings and termination timings of the trapezoidal waveforms Adp1, Adp2, Bdp1, and Bdp2 are commonly a voltage Vc. That is, each of the trapezoidal waveforms Adp1, Adp2, Bdp1, and Bdp2 is a waveform that starts at the voltage Vc and ends at the voltage Vc. Further, a period Ta including the period T1 and the period T2 corresponds to a printing period during which dots are formed on the medium P.

Although FIG. 8 illustrates that the trapezoidal waveform Adp1 and the trapezoidal waveform Bdp2 have the same waveform, the trapezoidal waveform Adp1 and the trapezoidal waveform Bdp2 may have different waveforms. Further, in the following description, it is described that the small amount of the ink is discharged both when the trapezoidal waveform Adp1 is supplied to the piezoelectric element 60 and when the trapezoidal waveform Bdp2 is supplied to the piezoelectric element 60. However, the present disclosure is not limited thereto. That is, the waveforms of the driving signals COMA and COMB are not limited to the waveforms illustrated in FIG. 8, and signals of combinations of various waveforms may be used in accordance with a moving speed of the carriage 71 on which the liquid discharging head 400 is mounted, properties of the discharged ink, and materials of the medium P. Further, the waveforms of the driving signals COMA and COMB supplied to each of the plurality of liquid discharging heads 400 may be different from each other.

Figure 9:
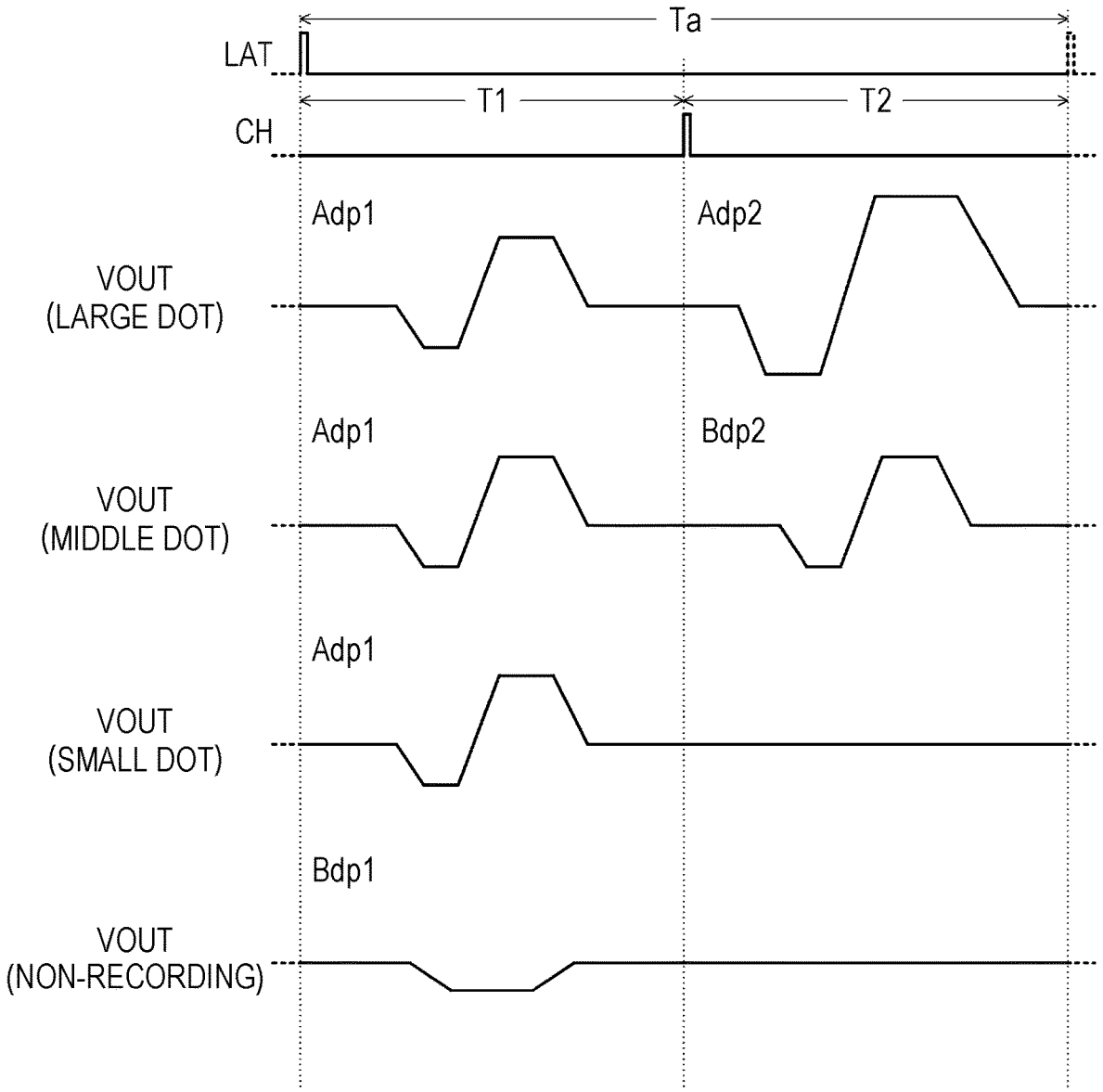
FIG. 9 is a diagram illustrating examples of waveforms of a driving signal VOUT.

FIG. 9 is a diagram illustrating examples of waveforms of the driving signal VOUT, corresponding to a "large dot", a "middle dot", and a "small dot" formed on the medium P and "non-recording", respectively.

As illustrated in FIG. 9, the driving signal VOUT corresponding to the "large dot" has a waveform in which, in the period Ta, the trapezoidal waveform Adp1 disposed in the period T1 and the trapezoidal waveform Adp2 disposed in the period T2 are continuous. When the driving signal VOUT is supplied to the one end of the piezoelectric element 60, in the period Ta, the small amount of the ink and the middle amount of the ink are discharged from the discharge portion 600 corresponding to the corresponding piezoelectric element 60. Thus, the ink lands and is coalesced, so that the large dot is formed on the medium P.

The driving signal VOUT corresponding to the "middle dot" has a waveform in which the trapezoidal waveform Adp1 disposed in the period T1 and the trapezoidal waveform Bdp2 disposed in the period T2 are continuous in the period Ta. When the driving signal VOUT is supplied to the one end of the piezoelectric element 60, the small amount of the ink is discharged twice from the discharge portion 600 corresponding to the corresponding piezoelectric element 60 in the period Ta. Thus, the ink lands and is coalesced, so that the middle dot is formed on the medium P.

The driving signal VOUT corresponding to the "small dot" has a waveform in which the trapezoidal waveform Adp1 disposed in the period T1 and a waveform that is disposed in the period T2 and is constant at the voltage Vc are continuous in the period Ta. When the driving signal VOUT is supplied to the one end of the piezoelectric element 60, in the period Ta, the small amount of the ink is discharged from the discharge portion 600 corresponding to the corresponding piezoelectric element 60. Thus, the ink lands, so that the small dot is formed on the medium P.

The driving signal VOUT corresponding to the "non-recording" has a waveform in which the trapezoidal waveform Bdp1 disposed in the period T1 and a waveform that is disposed in the period T2 and is constant at the voltage Vc are continuous in the period Ta. When the driving signal VOUT is supplied to the one end of the piezoelectric element 60, in the period Ta, the ink near the nozzle opening portion of the discharge portion 600 corresponding to the corresponding piezoelectric element 60 slightly vibrates, so that the ink is not discharged. Thus, as the ink does not land, no dot is formed on the medium P.

Here, the waveform that is constant at the voltage Vc is a waveform in which when none of the trapezoidal waveforms Adp1, Adp2, Bdp1, and Bdp2 is selected as the driving signal VOUT, the immediately preceding voltage Vc is maintained by a capacitive component of the piezoelectric element 60. When none of the trapezoidal waveforms Adp1, Adp2, Bdp1, and Bdp2 is selected as the driving signal VOUT, the voltage Vc as the driving signal VOUT is supplied to the piezoelectric element 60.

Figure 10:
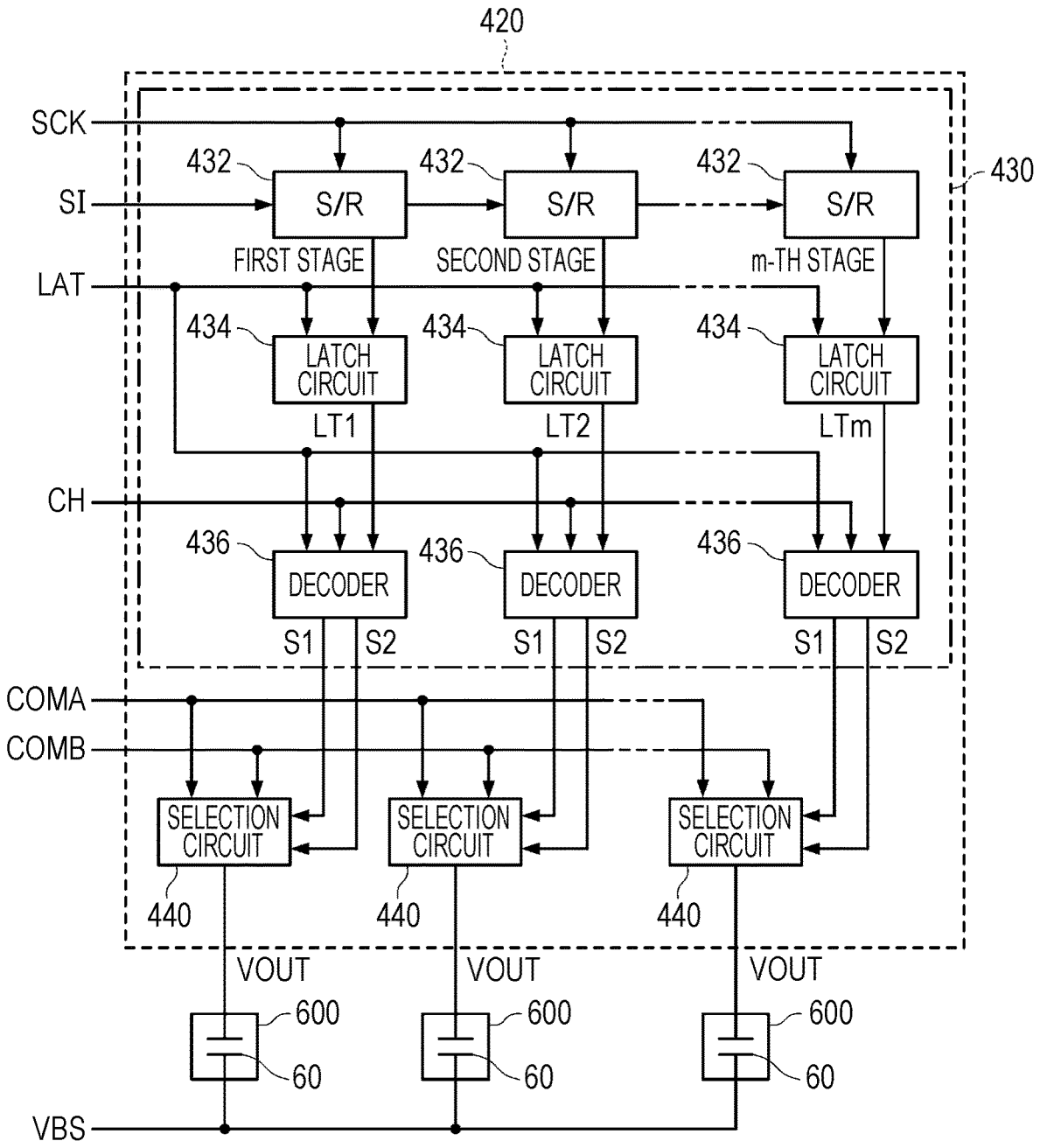
FIG. 10 is a diagram illustrating a configuration of a driving signal selection circuit.

Next, a configuration and an operation of the driving signal selection circuit 420 that selects the waveforms of the driving signals COMA and COMB and generates the driving signal VOUT will be described. FIG. 10 is a diagram illustrating a configuration of the driving signal selection circuit 420. As illustrated in FIG. 10, the driving signal selection circuit 420 includes the selection control circuit 430 and a plurality of selection circuits 440.

The printing data signal SI, the latch signal LAT, the change signal CH, and the clock signal SCK are input to the selection control circuit 430. Further, in the selection control circuit 430, a set of a shift register (S/R) 432, a latch circuit 434, and a decoder 436 is provided to correspond to each of the plurality of discharge portions 600. That is, the driving signal selection circuit 420 includes the sets of the shift registers 432, the latch circuits 434, and the decoders 436, the number of which is the same as the total number m of the corresponding discharge portions 600.

In detail, the printing data signal SI is a signal synchronized with the clock signal SCK, and is a signal having 2 m bits totally including 2-bit printing data [SIH, SIL] for selecting any one of the "large dot", the "middle dot", the "small dot", and the "non-recording" with respect to each of the m discharge portions 600. The printing data signal SI is held in the shift register 432 for each 2-bit printing data [SIH, SIL] included in the printing data signal SI, corresponding to the discharge portion 600. In detail, the m stages of the shift registers 432 corresponding to the discharge portions 600 are cascade-coupled to each other, and the serially input printing data signal SI is sequentially transferred to the subsequent stage in accordance with the clock signal SCK. FIG. 10, in order to distinguish the shift registers 432, the shift registers 432 are sequentially represented by a first stage, a second stage, . . . , an m-th stage from an upstream where the printing data signal SI is input.

The m latch circuits 434 latch the 2-bit printing data [SIH, SIL] held by the m shift registers 432 at rising of the latch signal LAT, respectively.

Figures 11, 12:
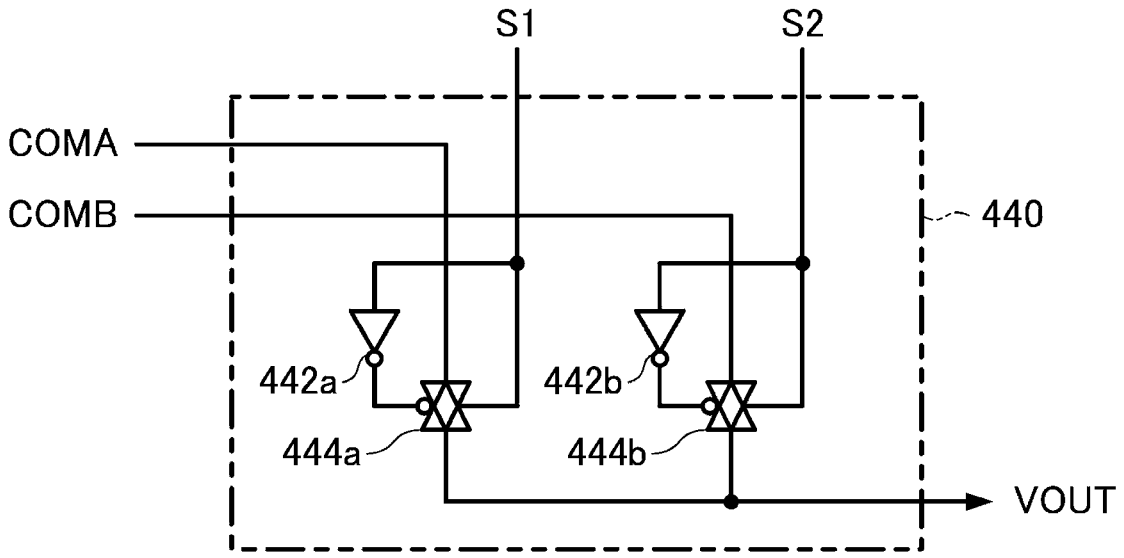
FIG. 11 is a table illustrating decoding content in a decoder.
FIG. 12 is a diagram illustrating a configuration of a selection circuit.

FIG. 11 is a diagram illustrating decoding contents in the decoder 436. The decoder 436 outputs selection signals S1 and S2 in accordance with the latched 2-bit printing data [SIH, SIL]. For example, when the 2-bit printing data [SIH, SIL] is [1, 0], the decoder 436 outputs a logic level of the selection signal S1 as levels H and L in the periods T1 and T2, and outputs a logic level of the selection signal S2 as levels L and H in the periods T1 and T2 to the selection circuit 440.

The selection circuits 440 are provided to correspond to the respective discharge portions 600. That is, the number of selection circuits 440 included in the driving signal selection circuit 420 is the same as the total number m of the relevant discharge portions 600. FIG. 12 is a diagram illustrating a configuration of the selection circuit 440 corresponding to one discharge portion 600. As illustrated in FIG. 12, the selection circuit 440 includes inverters 442*a* and 442*b* which are NOT circuits, and transfer gates 444*a* and 444*b*.

The selection signal S1 is input to a positive control end not marked by a circle in the transfer gate 444*a*, is logically inverted by the inverter 442*a*, and is input to a negative control end marked by a circle in the transfer gate 444*a*. Further, the driving signal COMA is supplied to an input end of the transfer gate 444*a*. The selection signal S2 is input to a positive control end not marked by a circle in the transfer gate 444*b*, is logically inverted by the inverter 442*b*, and is input to a negative control end marked by a circle in the transfer gate 444*b*. Further, the driving signal COMB is supplied to an input end of the transfer gate 444*b*. Further, output ends of the transfer gates 444*a* and 444*b* are commonly coupled to each other, and the driving signal VOUT is output.

Specifically, the transfer gate 444*a* conducts an input end and an output end when the selection signal S1 is at the level H, and does not conduct the input end and the output end when the selection signal S1 is at the level L. Further, the transfer gate 444*b* conducts the input end and an output end when the selection signal S2 is at the level H, and does not conduct the input end and the output end when the selection signal S2 is at the level L. As above, the selection circuit 440 selects the waveforms of the driving signals COMA and COMB based on the selection signals S1 and S2, and outputs the driving signal VOUT.

Figure 13:
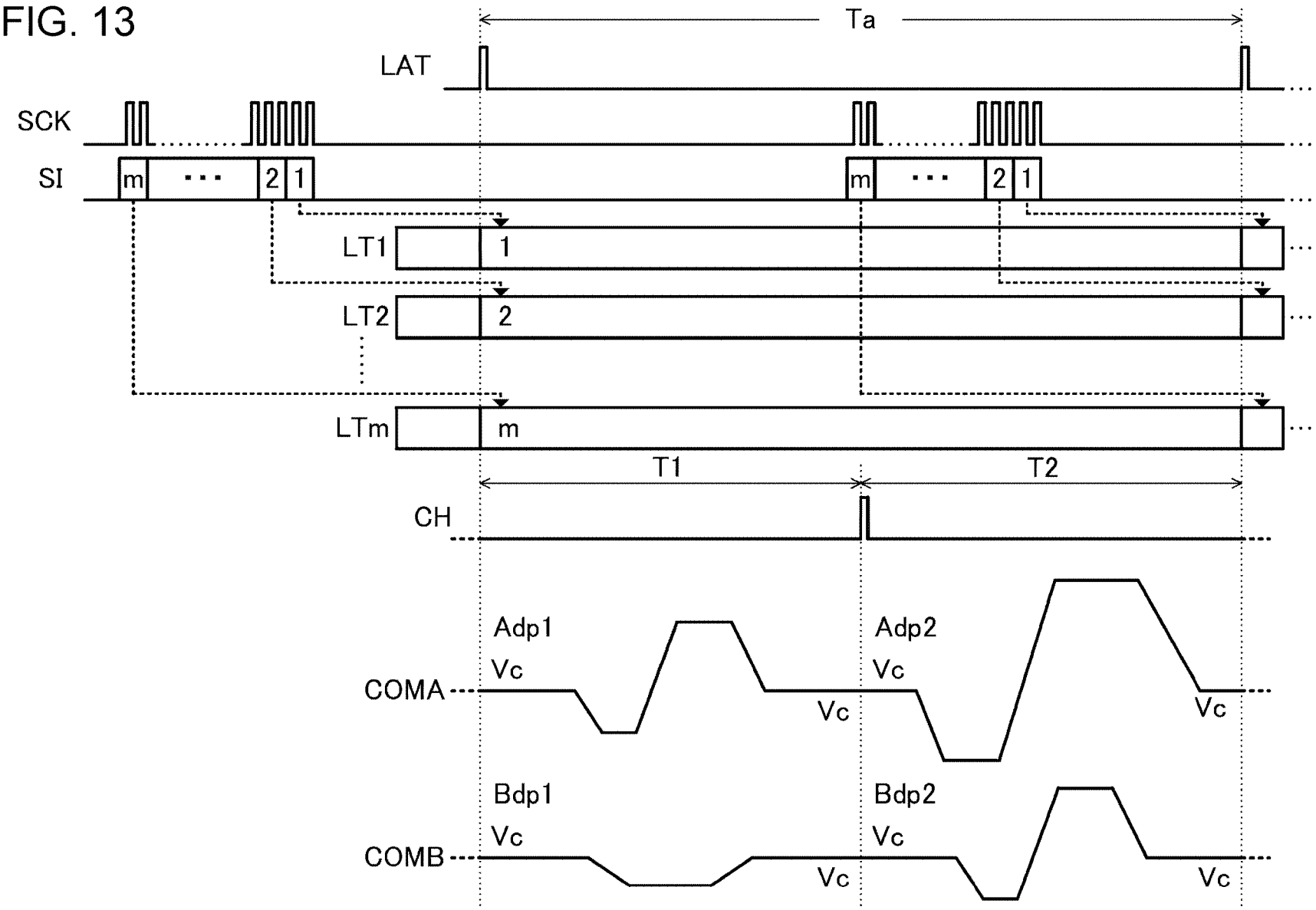
FIG. 13 is a diagram for illustrating an operation of the driving signal selection circuit.

Here, an operation of the driving signal selection circuit 420 will be described with reference to FIG. 13. FIG. 13 is a diagram for illustrating the operation of the driving signal selection circuit 420. The printing data signal SI is serially input in synchronization with the clock signal SCK, and is sequentially transferred in the shift registers 432 corresponding to the discharge portions 600. Further, when the input of the clock signal SCK is stopped, the shift registers 432 hold the 2-bit printing data [SIH, SIL] corresponding to the discharge portions 600, respectively. The printing data signal SI is input in an order corresponding to the discharge portions 600 of the m-th stage, . . . , the second stage, and the first stage of the shift registers 432.

Further, when the latch signal LAT rises, the latch circuits 434 latch the 2-bit printing data [SIH, SIL] held in the shift registers 432 all at once, respectively. In FIG. 13, LT1, LT2, . . . , LTm indicate the 2-bit printing data [SIH, SIL] latched by the latch circuits 434 corresponding to the shift registers 432 of the first stage, the second stage, . . . , the m-th stage.

The decoder 436 outputs the logic levels of the selection signals S1 and S2 in the periods T1 and T2, using contents illustrated in FIG. 11, in accordance with the size of a dot prescribed by the latched 2-bit printing data [SIH, SIL].

Specifically, when the printing data [SIH, SIL] is [1, 1], the decoder 436 sets the selection signal S1 to levels H and H in the periods T1 and T2, and sets the selection signal S2 to levels L and L in the periods T1 and T2. In this case, the selection circuit 440 selects the trapezoidal waveform Adp1 in the period T1, and selects the trapezoidal waveform Adp2 in the period T2. As a result, the driving signal VOUT corresponding to the "large dot" illustrated in FIG. 9 is generated.

Further, when the printing data [SIH, SIL] is [1, 0], the decoder 436 sets the selection signal S1 to levels H and L in the periods T1 and T2, and sets the selection signal S2 to levels L and H in the periods T1 and T2. In this case, the selection circuit 440 selects the trapezoidal waveform Adp1 in the period T1, and selects the trapezoidal waveform Bdp2 in the period T2. As a result, the driving signal VOUT corresponding to the "middle dot" illustrated in FIG. 9 is generated.

Further, when the printing data [SIH, SIL] is [0, 1], the decoder 436 sets the selection signal S1 to levels H and L in the periods T1 and T2, and sets the selection signal S2 to levels L and L in the periods T1 and T2. In this case, the selection circuit 440 selects the trapezoidal waveform Adp1 in the period T1, and selects neither the trapezoidal waveform Adp2 nor the trapezoidal waveform Bdp2 in the period T2. As a result, the driving signal VOUT corresponding to the "small dot" illustrated in FIG. 9 is generated.

Further, when the printing data [SIH, SIL] is [0, 0], the decoder 436 sets the selection signal S1 to levels L and L in the periods T1 and T2, and sets the selection signal S2 to levels H and L in the periods T1 and T2. In this case, the selection circuit 440 selects the trapezoidal waveform Bdp1 in the period T1, and selects neither the trapezoidal waveform Adp2 nor the trapezoidal waveform Bdp2 in the period T2. As a result, the driving signal VOUT corresponding to "non-recording" illustrated in FIG. 9 is generated.

As above, the driving signal selection circuit 420 selects waveforms of the driving signals COMA and COMB based on the printing data signal SI, the latch signal LAT, the change signal CH, and the clock signal SCK, and outputs the driving signal VOUT. In other words, the driving signal selection circuit 420 controls supply of the driving signals COMA and COMB to the piezoelectric element 60.

4. Details of Electrical Connection of Main Control Circuit and Discharge Control Circuit Here, details of configurations of the head control unit 10 and the head unit 20 and details of signals propagated between the head control unit 10 and the head unit 20 will be described.

Figure 14:
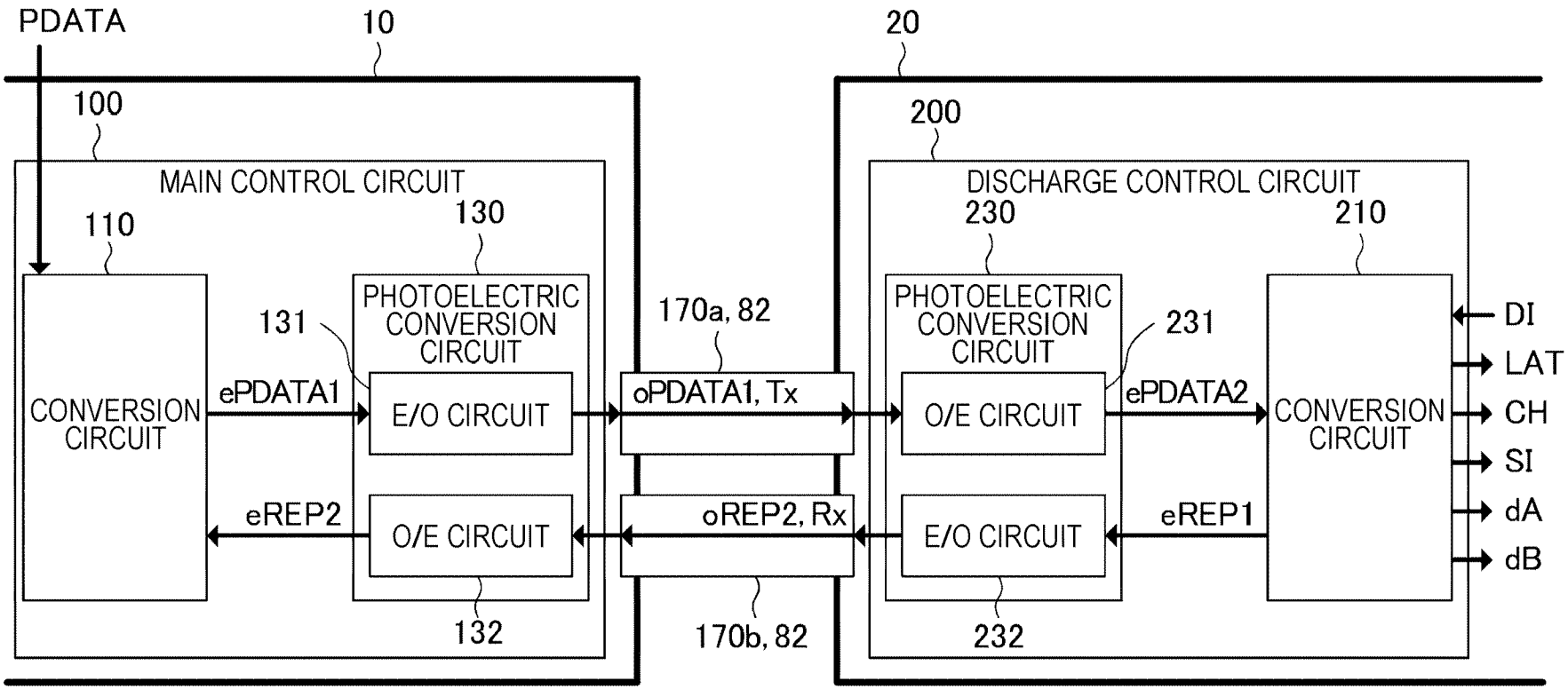
FIG. 14 is a diagram illustrating configurations of a head control unit and a head unit.

FIG. 14 is a diagram illustrating configurations of the head control unit 10 and the head unit 20. As illustrated in FIG. 14, the head control unit 10 includes the main control circuit 100 which includes a conversion circuit 110 and a photoelectric conversion circuit 130. Further, the head control unit 10 and the head unit 20 are connected through optical cables 170*a* and 170*b* in the cable 82 for communication. The optical cables 170*a* and 170*b* may be, for example, an optical fiber cable.

The conversion circuit 110 converts the image signal PDATA, which is supplied from a not-shown host computer or the like, into an image signal ePDATA1 which is an electric signal. Further, the conversion circuit 110 outputs the image signal ePDATA1 to the photoelectric conversion circuit 130. Further, a response signal eREP2 is input to the conversion circuit 110. The response signal eREP2 is a signal which indicates that the image signal ePDATA1 output by the conversion circuit 110 is normally propagated to the relevant head unit 20. Here, an image signal oPDATA corresponds to the transmission signal Tx illustrated in FIG. 1, and a response signal oREP corresponds to the reception signal Rx illustrated in FIG. 1.

The photoelectric conversion circuit 130 includes an E/O circuit 131 and an O/E circuit 132. The E/O circuit 131 includes a light emitting element or the like, and converts the input electric signal into the optical signal. Specifically, the image signal ePDATA1, which is the electric signal, is input to the E/O circuit 131. Further, the E/O circuit 131 converts the image signal ePDATA1 into the image signal oPDATA which is the optical signal. Further, the O/E circuit 132 includes a light receiving element or the like, and converts the input optical signal into the electric signal. Specifically, the response signal oREP, which is the optical signal, is input to the O/E circuit 132. Further, the O/E circuit 132 converts the response signal oREP into the response signal eREP2 which is the electric signal.

Here, the conversion circuit 110, which converts the image signal PDATA including image data input from the host computer provided on the outside of the liquid discharging apparatus 1 into the image signal ePDATA1 that is the electric signal, is an example of a first conversion circuit, the image signal ePDATA1 is an example of a first electric signal, and a process of converting the image signal PDATA into the image signal ePDATA1 by the conversion circuit 110 is an example of a first conversion process. Further, the photoelectric conversion circuit 130, which converts the image signal ePDATA1 that is the electric signal into the image signal oPDATA that is the optical signal, is an example of a first photoelectric conversion circuit.

The head unit 20 includes a discharge control circuit 200 including a conversion circuit 210 and a photoelectric conversion circuit 230.

The photoelectric conversion circuit 230 includes an O/E circuit 231 and an E/O circuit 232. The O/E circuit 231 includes the light receiving element or the like, and converts the input optical signal into the electric signal. Specifically, the image signal oPDATA, which is the optical signal, is input to the O/E circuit 231. Further, the O/E circuit 231 converts the image signal oPDATA into an image signal ePDATA2 which is the electric signal. Further, the E/O circuit 232 includes a light emitting element or the like, and converts the input electric signal into the optical signal. Specifically, a response signal eREP1, which is the electric signal, is input to the E/O circuit 232. Further, the E/O circuit 232 converts the response signal eREP1 into the response signal oREP which is the optical signal.

Discharge information DI of the liquid discharging head 400 is input to the conversion circuit 210. Further, the conversion circuit 210 converts the image signal ePDATA2 into the printing data signal SI, the latch signal LAT, the change signal CH, the clock signal SCK, and the base driving signals dA and dB based on the discharge information DI. Further, the conversion circuit 210 generates the response signal eREP1, which indicates that the image signal ePDATA2 is normally received, and outputs the response signal eREP1 to the E/O circuit 232.

Here, the photoelectric conversion circuit 230, which converts the optical signal that is input from the head control unit 10 into the image signal ePDATA2, is an example of a second photoelectric conversion circuit, and the image signal ePDATA2 is an example of a second electric signal. Further, the conversion circuit 210, which converts the image signal ePDATA2 that is the electric signal into the printing data signal SI, the latch signal LAT, the change signal CH, and the clock signal SCK, is an example of a second conversion circuit, at least one of the printing data signal SI, the latch signal LAT, the change signal CH, and the clock signal SCK is an example of a discharge control signal for controlling discharge of a liquid from the nozzles 651, and a process for converting the image signal ePDATA2 into the discharge control signal is an example of the second conversion process.

The image signal ePDATA1 acquired before being converted into the optical signal in the main control circuit 100 may be the same signal as the image signal ePDATA2 which is converted from the optical signal in the discharge control circuit 200. Further, the response signal eREP1 acquired before being converted into the optical signal in the discharge control circuit 200 may be the same signal as the response signal eREP2 which is converted from the optical signal in the main control circuit 100.

5. Generation of Discharge Control Signal

As described above, in the liquid discharging apparatus 1 of the exemplary embodiment, the image signal PDATA, which includes the image data input from the host computer, is converted into the discharge control signal corresponding to each of the nozzles 651 in a process of being propagated in the conversion circuit 110, the photoelectric conversion circuit 130, the photoelectric conversion circuit 230, and the conversion circuit 210, and is output from the discharge control circuit 200.

Figure 15:
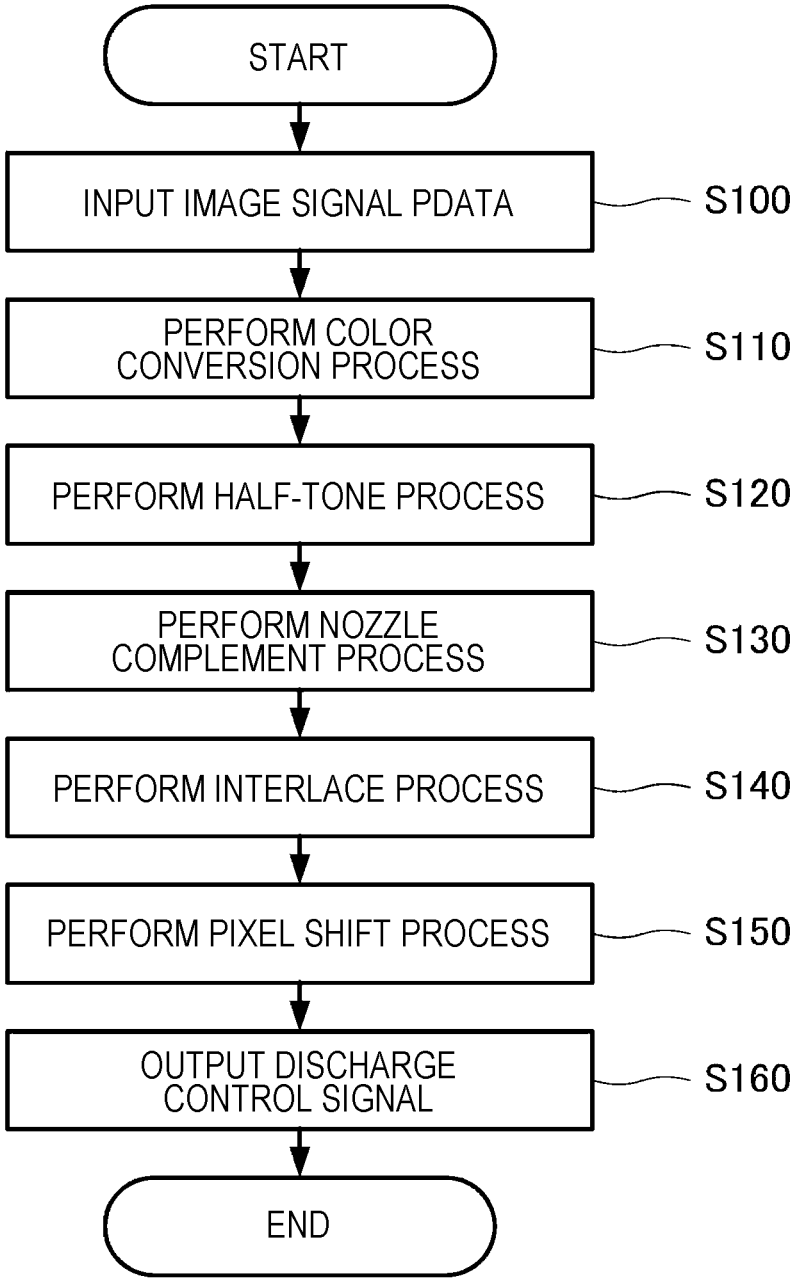
FIG. 15 is a flowchart illustrating a conversion processing method for converting an image signal PDATA into a discharge control signal.

Here, a conversion process of converting the image signal PDATA, which includes the image data input from the host computer, into the discharge control signal, which corresponds to each of the nozzles 651, will be described with reference to FIGS. 14 and 15. FIG. 15 is a flowchart illustrating a conversion processing method for converting the image signal PDATA into the discharge control signal.

In the liquid discharging apparatus 1 according to the exemplary embodiment, the conversion circuit 110 converts the image signal PDATA into the image signal ePDATA1 without depending on the discharge information DI of the ink discharged from the liquid discharging head 400, and the conversion circuit 210 converts the image signal ePDATA2 into the discharge control signal by using the discharge information DI.

Specifically, as illustrated in FIG. 15, the image signal PDATA, which includes the image data, is input from the host computer to the main control circuit 100 of the liquid discharging apparatus 1 (step S100).

Further, the image signal PDATA, which is input to the main control circuit 100, is input to the conversion circuit 110. Further, the conversion circuit 110 performs a color conversion process on the image signal PDATA (step S110). The color conversion process is a process of converting color information corresponding to a hue of the image data included in the image signal PDATA into the color information corresponding to a hue of the liquid which is discharged from the nozzles 651. For example, when the image data included in the image signal PDATA is realized by combining grayscale values of red, green, and blue, the color conversion process is a process of converting the image data into image data which is realized by combining grayscales of cyan, magenta, yellow, and black of a color of the ink used in the liquid discharging apparatus 1. It is possible to rapidly perform the color conversion process by referring to a 3-dimensional numerical table called a color conversion table. The ink used in the liquid discharging apparatus 1 is not limited to the above described ink, and, for example, light cyan or light magenta may be included.

Next, the conversion circuit 110 performs a half-tone process with respect to the image signal PDATA on which the color conversion process is performed (step S120). The half-tone process is a binarization process of converting the image signal PDATA into a signal which indicates whether or not the ink corresponding to a pixel included in the image data is discharged, and is a process of determining a position of the medium to which the ink is discharged in order to reproduce grayscale information of the input image signal PDATA. The binarization process may include a process of determining the amount of ink to be discharged to the medium, in addition to a process of determining whether or not the ink is discharged with respect to the-above described medium. Further, the half-tone process may be performed through, for example, dithering using a dither mask.

Further, the image signal PDATA, on which the color conversion process and the half-tone process are performed, is output as the image signal ePDATA1 from the conversion circuit 110. That is, the conversion circuit 110 outputs a signal, which is acquired by performing the binarization process on the image signal PDATA, as the image signal ePDATA1. Further, the image signal ePDATA1 is supplied to the head unit 20 after being converted into the image signal oPDATA, which is the optical signal, in the photoelectric conversion circuit 130.

Here, the above-described color conversion process and the half-tone process are performed with respect to the image signal PDATA in accordance with a predetermined arithmetic operation. That is, the color conversion process and the half-tone process are processes which do not rely on the discharge information DI of the ink discharged from the liquid discharging head 400, and the conversion circuit 110 performs the process which does not rely on the discharge information DI. Further, the conversion circuit 110 may perform only the color conversion process and may output a signal, which is acquired by performing the color conversion process on the image signal PDATA, as the image signal ePDATA. However, as illustrated in the exemplary embodiment, it is preferable that the conversion circuit 110 performs the process up to the half-tone process, and outputs a signal, which is acquired by performing the color conversion process and the half-tone process on the image signal PDATA, as the image signal ePDATA1. As will be described later, the head unit 20 converts the image signal ePDATA2 into the discharge control signal corresponding to the plurality of nozzles 651 included in the liquid discharging head 400. Therefore, a load of the process performed in the head unit 20 becomes large, compared to the process performed by the head control unit 10. As illustrated in the exemplary embodiment, when a larger number of processes, which are possible without using the discharge information DI, are performed in the head control unit 10, it is possible to reduce the load of the process in the head unit 20.

The image signal oPDATA supplied to the head unit 20 is input to the conversion circuit 210 after being converted into the image signal ePDATA2, which is the electric signal, in the photoelectric conversion circuit 230. Further, the conversion circuit 210 performs a nozzle complement process with respect to the image signal ePDATA2 (step S130). When a nozzle 651 which is not capable of normally discharging the ink exists in the plurality of nozzles 651 included in the liquid discharging head 400, the nozzle complement process is a process of complementing the ink to be originally discharged from the nozzle 651, from which the ink is not discharged, by adjusting the discharge amount of the ink which is discharged from another nozzle 651 provided in the vicinity of the relevant nozzle 651. Specifically, information, which indicates whether or not the liquid is discharged from the nozzles 651, is input as the discharge information DI to the conversion circuit 210. In other words, the discharge information DI includes information, which indicates whether or not the liquid is discharged from the nozzles 651. Further, based on the discharge information DI, a process of determining whether or not the nozzle 651, which is not capable of normally discharging the ink, exists is performed. Further, when the nozzle 651 from which the ink is not discharged exists, the process of adjusting the discharge amount of the ink discharged from another nozzle 651 provided in the vicinity of the relevant nozzle 651 is performed.

Here, as the discharge information DI which indicates whether or not the nozzle 651 which is not capable of normally discharging the ink exists, there are provided, for example, a method for detecting a waveform, which is generated after discharging the ink, of a residual vibration of the piezoelectric elements 60, a method for causing ink drops discharged from the nozzles 651 to be irradiated with laser light and detecting a change in the amount of light of the laser light, and the like.

Further, the conversion circuit 210 performs an interlace process with respect to the image signal ePDATA2 (step S140). The interlace process is a process of performing conversion on pixel information included in the input image signal ePDATA2 in order corresponding to the nozzles 651 included in the liquid discharging head 400. For example, when the image data included in the input image signal ePDATA2 is the pixel information arranged in a direction intersecting with respect to a transport direction of the medium P and columns of the nozzles included in the liquid discharging head 400 are provided to be parallel to the transport direction of the medium P, the interlace process includes a vertical conversion process of rearranging the pixel information included in the image signal ePDATA2 in order corresponding to the nozzles 651. Further, in the liquid discharging head 400 in which one pseudo nozzle column is formed by a plurality of nozzle columns, when the nozzles 651 provided in different nozzle columns are provided in positions, which overlap in a movement direction of the carriage 71, the interlace process includes a process of correcting the discharge amount of the ink in each of the overlapping nozzles 651.

Further, the conversion circuit 210 performs a pixel shift process with respect to the image signal ePDATA2 (step S150). The pixel shift process is a process of correcting discharge timing of the ink which is discharged from the nozzles 651 based on a difference between an ideal landing position of the medium P, which is desired to make the ink discharged from the nozzles 651 land, and a real landing position on which the ink actually lands. Specifically, the liquid discharging head 400 acquires information of the real landing position using image recognition using a camera or the like, hue recognition based on a color of an image formed on the medium, or the like. Further, the discharge information DI, which includes the difference between the real landing position and the ideal landing position, is input to the conversion circuit 210. The conversion circuit 210 performs a process of correcting the discharge timing of the ink which is discharged from the nozzles 651 based on the input discharge information DI.

As above, the conversion circuit 210 converts the image signal ePDATA2 from a signal corresponding to the pixel included in the image data into the signal corresponding to each of the nozzles 651. In other words, the conversion circuit 210 includes a nozzle correspondence process of performing conversion into a signal which indicates whether or not the ink is discharged from the nozzles 651 in correspondence to the nozzles 651. Steps S130, S140, and S150 illustrated in FIG. 15 may be performed in any order.

After the nozzle complement process, the interlace process, and the pixel shift process, which are described above, are performed, the conversion circuit 210 generates and outputs the printing data signal SI, the latch signal LAT, the change signal CH, and the clock signal SCK, as the discharge control signal (step S160).

6. Effects

The liquid discharging apparatus 1 of the above-described exemplary embodiment includes: the head control unit 10 including the conversion circuit 110 that converts the image signal PDATA including the image data input from the outside into the image signal ePDATA, and the photoelectric conversion circuit 130 that converts the image signal ePDATA into the image signal oPDATA which is the optical signal; and the head unit 20 including the photoelectric conversion circuit 230 that converts the image signal oPDATA, which is the optical signal, into the image signal ePDATA2, the conversion circuit 210 that converts the image signal ePDATA into the discharge control signal for controlling the discharge of the liquid from the nozzles 651, and the liquid discharging head 400 that discharges the liquid from the nozzles 651 by driving the piezoelectric elements 60 based on the discharge control signal. That is, in the liquid discharging apparatus 1, the discharge control signal for controlling the discharge of the ink from the liquid discharging head 400 is propagated as the optical signal between the head control unit 10 and the head unit 20.

Further, the conversion circuit 110 performs the process of converting the image signal PDATA into the image signal ePDATA1 without depending on the discharge information DI of the liquid discharged from the liquid discharging head 400, and the conversion circuit 210 performs the process of converting the image signal ePDATA2 into the discharge control signal using the discharge information DI. That is, the conversion circuit 210, which is included in the liquid head unit 20 that includes the discharging head 400, performs a conversion process using the discharge information DI of the ink discharged from the liquid discharging head 400, and the conversion circuit 110, which is included in the head control unit 10 that does not include the liquid discharging head 400, performs a conversion process which does not rely on the discharge information DI of the ink discharged from the liquid discharging head 400. Therefore, it is not necessary to propagate the discharge information DI with respect to the conversion circuit 110 which performs the process that does not rely on the discharge information DI of the ink. Accordingly, it is not necessary to convert the discharge information DI of the ink into the optical signal in order to generate the discharge control signal for controlling drive of the piezoelectric elements 60. Therefore, it is possible to reduce time which is required to generate the discharge control signal, and thus it is possible to improve a control speed of the liquid discharging apparatus 1.

Although the exemplary embodiments and the modification examples have been described above, the present disclosure is not limited to these exemplary embodiments, and may be carried out in various modes without departing from the gist thereto. For example, the above-described embodiments can be combined appropriately.

The present disclosure includes substantially the same configuration (for example, a configuration having the same function, method, and result or a configuration of the same purpose and effect) as the configuration described in the exemplary embodiment. Further, the present disclosure includes configurations in which nonessential parts of the configurations described in the embodiments are replaced. Further, the present disclosure also includes configurations that have the same effects as those of the embodiments or configurations that can achieve the same objects as those of the embodiments. Further, the present disclosure includes a configuration obtained by adding a Known technique to the configurations described in the embodiments.

What is claimed is:

1. A liquid discharging apparatus comprising:

a head unit that discharges a liquid from a nozzle; and a head control unit that controls an operation of the head unit, wherein the head control unit includes a first conversion circuit that converts an image signal, which includes image data input from an outside, into a first electric signal, and a first photoelectric conversion circuit that converts the first electric signal into an optical signal, the head unit includes a second photoelectric conversion circuit that converts the optical signal into a second electric signal, a second conversion circuit that converts the second electric signal into a discharge control signal for controlling discharge of a liquid from the nozzle, and a liquid discharging head that includes a driving element, which is driven based on the discharge control signal, and that discharges a liquid from the nozzle in accordance with drive of the driving element, the first conversion circuit performs a first conversion process of converting the image signal into the first electric signal without depending on a discharge information of a liquid discharged from the liquid discharging head, the second conversion circuit performs a second conversion process of converting the second electric signal into the discharge control signal by using the discharge information, and the discharge information includes information which indicates whether the nozzle is not capable of normally discharging liquid.

2. The liquid discharging apparatus according to claim 1, wherein the first conversion process includes a color conversion process of converting color information corresponding to a hue of the image data included in the image signal into color information corresponding to a hue of a liquid discharged from the nozzles.

3. The liquid discharging apparatus according to claim 1, wherein the first conversion process includes a binarization process of converting the image signal into a signal which indicates whether or not a liquid corresponding to a pixel included in the image data is discharged.

4. The liquid discharging apparatus according to claim 3, wherein the first electric signal is a signal acquired by performing the binarization process on a signal based on the image signal.

5. The liquid discharging apparatus according to claim 1, wherein the second conversion process includes a nozzle correspondence process of converting the second electric signal into a signal which indicates whether or not a liquid corresponding to the nozzle is discharged.

6. A head control unit, which controls an operation of a head unit that discharges a liquid from a nozzle, the head control unit comprising:

a first conversion circuit that converts an image signal, which includes image data input from an outside, into a first electric signal; and a first photoelectric conversion circuit that converts the first electric signal into an optical signal, wherein the head control unit receives discharge information of a liquid discharged from the nozzle, the first conversion circuit performs a first conversion process of converting the image signal into the first electric signal without depending on the discharge information, and the discharge information includes information which indicates whether the nozzle is not capable of normally discharging liquid.

7. A head unit, which discharges a liquid from a nozzle based on a signal input from a head control unit, the head unit comprising:

a second photoelectric conversion circuit that receives an optical signal input from the head control unit, and converts the optical signal into a second electric signal;

a second conversion circuit that converts the second electric signal into a discharge control signal for controlling discharge of a liquid from the nozzle; and a liquid discharging head that includes a driving element, which is driven based on the discharge control signal, and that discharges a liquid from the nozzle in accordance with drive of the driving element, wherein the second conversion circuit performs a second conversion process of converting the second electric signal into the discharge control signal by using a discharge information of a liquid discharged from the liquid discharging head, and the discharge information includes information which indicates whether the nozzle is not capable of normally discharging liquid.

* * * * *